US009982441B2

(12) United States Patent
Gleeson et al.

(10) Patent No.: US 9,982,441 B2
(45) Date of Patent: May 29, 2018

(54) COMPOSITE ACOUSTIC DAMPING BATTEN

(71) Applicant: James Hardie Technology Limited, Dublin (IE)

(72) Inventors: James Gleeson, Sydney (AU); Karl Laing, Sydney (AU); Jeremy McCandless, Sydney (AU); Peter Pagones, Sydney (AU)

(73) Assignee: James Hardie Technology Limited, Dublin (IE)

( * ) Notice: Subject to any disclaimer, the term of this patent is extended or adjusted under 35 U.S.C. 154(b) by 0 days. days.

(21) Appl. No.: 15/115,628

(22) PCT Filed: Feb. 2, 2015

(86) PCT No.: PCT/EP2015/052044
§ 371 (c)(1),
(2) Date: Jul. 29, 2016

(87) PCT Pub. No.: WO2015/114130
PCT Pub. Date: Aug. 6, 2015

(65) Prior Publication Data

US 2017/0159302 A1 Jun. 8, 2017

(30) Foreign Application Priority Data

Jan. 31, 2014 (GB) ..... 1401714.9

(51) Int. Cl.
*E04F 15/20* (2006.01)
*E04B 1/82* (2006.01)
*E04F 15/22* (2006.01)

(52) U.S. Cl.
CPC ..... *E04F 15/20* (2013.01); *E04B 1/8209* (2013.01); *E04B 2001/8254* (2013.01); *E04F 15/225* (2013.01)

(58) Field of Classification Search
CPC ..... E04F 15/20; E04F 15/225; E04B 1/8209; E04B 2001/8254
(Continued)

(56) References Cited

U.S. PATENT DOCUMENTS 2,088,566 A * 8/1937 Avery ..... F16F 3/093 248/615
2,713,485 A * 7/1955 Tillou ..... F16F 1/403 213/40 D (Continued)

FOREIGN PATENT DOCUMENTS

WO WO-2005033436 A1 * 4/2005 ..... E04F 15/225
WO WO 2015/114130 8/2015

OTHER PUBLICATIONS

International Search Report and Written Opinion for corresponding PCT Application No. PCT/EP2015/052044, filed Feb. 2, 2015, dated May 22, 2015, 11 pages.

*Primary Examiner* — Adriana Figueroa
(74) *Attorney, Agent, or Firm* — Knobbe Martens Olson & Bear, LLP

(57) ABSTRACT

A composite acoustic damping batten suitable for interposition between first and second building elements, the composite acoustic damping batten comprising at least two resilient portions, each resilient portion comprising a first face and a second face, the first and second resilient portions of the at least two resilient portions being conjoined such that the first face of the first resilient portion and second face of the second resilient portion are spaced apart from each other forming opposing external surfaces of the composite acoustic damping batten; wherein the first face of the first resilient portion is configured for securable contacting engagement with the first building material; and the second face of the second resilient portion is configured for secur-
(Continued)

able contacting engagement with the second building material.

24 Claims, 20 Drawing Sheets

(58) Field of Classification Search
USPC ..... 52/403.1
See application file for complete search history.

(56) References Cited

U.S. PATENT DOCUMENTS 2,862,255 A 12/1958 Nelson
4,002,315 A * 1/1977 Van Goubergen ..... F16F 1/376 248/633
4,727,695 A * 3/1988 Kemeny ..... E04H 9/022 14/73.5
4,856,250 A * 8/1989 Gronau ..... E04F 15/04 52/376
4,860,516 A * 8/1989 Koller ..... A63C 19/00 52/480
4,879,857 A * 11/1989 Peterson ..... E01C 13/02 248/632
5,277,010 A * 1/1994 Stephenson ..... E04F 15/225 52/403.1
5,330,165 A * 7/1994 van Goubergen ..... F16F 1/374 248/633
5,518,802 A * 5/1996 Colvin ..... B32B 3/12 428/166
6,115,981 A * 9/2000 Counihan ..... E04F 15/22 52/403.1
6,931,808 B2 * 8/2005 Hamar ..... E04F 15/225 52/393
7,338,038 B2 * 3/2008 Maurer ..... F16F 7/08 267/139
8,622,169 B2 * 1/2014 Kim ..... E04F 15/20 181/290
9,133,628 B2 * 9/2015 Moller, Jr. ..... E04F 15/225
2002/0108340 A1 * 8/2002 Elliott ..... E04F 15/225 52/403.1
2002/0108341 A1 8/2002 Hamar

* cited by examiner

COMPOSITE ACOUSTIC DAMPING BATTEN

The present invention relates to a building element that is suitable for use as a batten and in particular for use as an acoustic damping batten.

It is recognised that acoustic resonance or noise transmissions within and between buildings is becoming a greater concern for building inhabitants, particularly as the density of habitation increases and as aesthetic tastes for hard surface finishes proliferates.

Building elements such as battens are used throughout the construction industry as structural and/or aesthetic components. Battens generally comprise thin strips of solid material made from, for example, wood, plastic or metal. Battens can be used in a variety of ways in building construction. Most commonly battens are used to provide a fixing point for facing materials, such as plaster board or dry wall, whereby the batten is secured to a structural wall or subframe and the plaster board or dry wall is secured to the batten. Battens are also used as support for flooring structures, wherein the battens are used to secure flooring sections to joists or structural substrates.

It is also known to use a damping material in conjunction with battens to reduce noise transmissions. Generally in such instances, thin strips of acoustic damping material are inserted either between the structural substrate and the batten or between the facing material and the batten. Such systems usually comprise many layers to achieve an improved acoustic performance. Consequently the assemblies are costly, complicated and labour intensive to install.

GB 2497805 discloses an acoustic building element for use with a batten to reduce acoustic energy transmission between flooring sheets and a flooring substructure. The acoustic damping building element is configured to receive a batten. The building element of GB 2497805 comprises a base member from which two side arms project forming a substantially 'U'-shaped channel. The 'U'-shaped channel is adapted to receive a batten. The batten is held in position within the 'U'-shaped channel by flanges extending from the side arms over the batten.

It is also known to fill the air spaces behind building panels and or sheets with insulating material to try to reduce noise transmissions. In many instances the batten, acoustic damping material and in some instances the insulating material are fixed directly to the structural substrate.

It is an object of the present invention to overcome or ameliorate at least one disadvantage of the prior art or to provide a useful alternative.

According to the invention, there is provided a composite acoustic damping batten suitable for interposition between first and second building materials, the composite acoustic damping batten comprising:

- at least two resilient portions, each resilient portion comprising a first face and a second face, the at least two resilient portions being conjoined such that the first face of a first resilient portion and the second face of a second resilient portion are spaced apart from each other to form opposing external surfaces of the composite acoustic damping batten;
- wherein the first face of the first resilient portion is configured for contacting engagement with a first building material such that the first building material and the first resilient portion of the composite acoustic damping batten are securable together; and
- wherein the second face of the second resilient portion is configured for contacting engagement with a second building material such that the second building material and the second resilient portion of the composite acoustic damping batten are securable together.

The advantage of the composite acoustic damping batten of the invention is that the composite batten provides a simple means by which a first building material, for example, a facing member such as a building sheet or a flooring section can be indirectly secured to a second building material, for example, a structural substrate or sub frame.

It is acknowledged that the term 'comprise' may, under varying jurisdictions be provided with either an exclusive or inclusive meaning. For the purpose of this specification, the term comprise shall have an inclusive meaning that it should be taken to mean an inclusion of not only the listed components it directly references, but also other non-specified components. Accordingly, the term 'comprise' is to be attributed with as broad an interpretation as possible within any given jurisdiction and this rationale should also be used when the terms 'comprised' and/or 'comprising' are used.

In the following, the composite acoustic damping batten of the invention will be described with reference to a first and second resilient portion, however, it is to be understood that further resilient portions can also be included in the composite acoustic damping batten of the invention as desired by the person skilled in the art. The or each further resilient portion is placed in the composite acoustic damping batten of the invention at a location determined by the person skilled in the art to enhance the performance of the product.

For example, in one embodiment of the invention, further resilient portions are placed intermediate the first and second resilient portions. Accordingly, in such an embodiment of the invention the or each subsequent resilient portion is arranged in series with the first and second resilient portion such that the first resilient portion is the starting resilient portion and the second resilient portion is the terminating resilient portion. Conveniently, the further resilient portions also comprise a first face and a second face. Accordingly, in this embodiment of the invention, the first face of each subsequent resilient portion is conjoined with the second face of the preceding resilient portion. It follows that the second face of each subsequent resilient portion is conjoined with the first face of the following resilient portion. In the final instance, the following resilient portion will be the terminating resilient portion. Advantageously, the or each subsequent layer can be used to enhance structural stability, noise reduction properties and or gripping means for securing the first and second materials respectively to the composite acoustic damping batten of the invention.

In one embodiment of the invention, the at least two resilient portions comprise materials which have different physical properties. The criteria used to select appropriate materials for the resilient portions include; mechanical strength required to support the first material, for example, a building sheet; mechanical strength required to provide holding strength for a fixing such as a nail or screw; the ability to deform slightly to conform with surface irregularities in either the surface of the first material or the surface of the second material, for example, a structural substrate surface; and acoustic damping properties. Mechanical properties of any material considered for use in the composite acoustic damping batten of the invention are summarised under a single value, a Shore A hardness number. Shore hardness values reflect not only the mechanical strength of a material via its resistance to point load application, but also the relative deformability.

In one embodiment of the invention, the at least two resilient portions comprise materials which have different Shore hardness measurements as measured on the Shore A durometer scale relative to each other. In one embodiment of the invention, one of the at least two resilient portions comprises a material which is harder than the other of the at least two resilient portions when measured on the Shore A durometer scale.

In a further embodiment of the invention, one or more of the at least two resilient portions comprises a material which has a Shore hardness value of greater than or equal to 55±3 as measured on the Shore A durometer scale. In a further embodiment of the invention one or more of the at least two resilient portions comprises a material which has a Shore hardness value of between approximately 30±3 and approximately 55±3 as measured on the Shore A durometer scale.

In a further embodiment of the invention, one of the at least two resilient portions comprises a material which has a Shore hardness value of between approximately 30±3 and 55±3 as measured on the Shore A durometer scale whilst the other of the at least two resilient portions has a Shore hardness value of greater than or equal to approximately 55±3 as measured on the Shore A durometer scale. In this embodiment of the invention, one of the resilient portions comprises a material which has sufficient strength to hold multiple fixings including nails and screws to secure the first building material to the composite acoustic damping batten of the invention yet is sufficiently malleable to absorb or dissipate sound transmissions. The other or second resilient portion comprises a harder material than that of the first resilient portion. The material of the other or second resilient portion comprises sufficient strength to secure the composite acoustic damping batten to the second building material such as a structural substrate. The advantage being that the composite acoustic damping batten of the invention is structurally strong yet structure borne vibrations are reduced and/or minimised.

Advantageously, the material will have characteristic sound absorption/transmission effectiveness depending on its inherent material properties as measured by the sound transmission coefficient (i). Accordingly, it is preferable for the materials of the at least two resilient portions to also have different sound transmission coefficients which function to absorb and/or dissipate sound transmissions which take the form of structure borne vibrations.

In one embodiment of the invention, one or more of the at least two resilient portions are formed from a range of resilient materials, preferable polymeric materials. Suitable polymeric materials include the family of elastomeric polymeric materials and/or the family of expandable polymeric material.

Accordingly, in one embodiment of the invention one or more of the at least two resilient portions comprise at least one elastomeric polymeric material selected from the group of materials comprising natural rubber, synthetic rubbers, gutta percha, styrene-butadiene rubbers, nitrile rubbers, polybutadiene rubbers, chloroprene rubbers, isoprene rubbers, halogenated butyl rubbers, ethylene propylene rubber, ethylene propylene diene rubbers, epichlorhydrin rubbers, polyacrylic rubbers, fluoroelastomers, perfluoroelastomers, silicone rubbers and polyether block amides (PEBA's).

In a further embodiment of the invention, one or more of the at least two resilient portions comprises at least one expandable polymeric material selected from the group comprising polyolefins, polyurethanes, polyvinyl chlorides, polyimides, polystyrenes, and polysiloxanes.

In a further embodiment of the invention, one or more of the at least two resilient portions comprises is a foamed polymeric material.

In a further embodiment of the invention, the composite acoustic damping batten comprises further resilient portions intermediate first and second resilient portions.

In one embodiment of the invention, the resilient portions of the composite acoustic damping batten are separately formed by processes such as, for example, extrusion. In such instances, any suitable method known to a person skilled in the art is used to seat the first and second resilient portions together such that the resilient portions are retained or locked into position together.

In a further embodiment of the invention, the resilient portions of the composite acoustic damping batten are integrally formed to form the composite acoustic damping batten whereby the second face of the first resilient portion and the first face of the second resiliently portion are conjoined and the first face of the first resilient portion and second face of the second resilient portion are spaced apart from each other such that the first face of the first resilient portion and second face of the second resilient portion form opposing external surfaces of the composite acoustic damping batten.

In one embodiment of the invention the first and second resilient portion are coextruded together to form the composite acoustic damping batten of the invention.

In a further embodiment of the invention, wherein the resilient portions of the composite acoustic damping batten are separately formed, the resilient portions seat together to form an composite acoustic damping batten whereby the second face of the first resilient portion and the first face of the second resilient portion are conjoined and the first face of the first resilient portion and second face of the second resilient portion are spaced apart from each other such that the first face of the first resilient portion and second face of the second resilient portion form opposing external surfaces of the composite acoustic damping batten.

In a further embodiment of the invention, the first and second resilient portions each comprise a surface profile, wherein the surface profile of the first resilient portion is a complementary mating surface profile to the surface profile of the second resilient portion. In one embodiment of the invention, the first and second resilient portions each comprise a complementary mating surface profile whereby the second face of the first resilient portion and the first face of the second resilient portion seat together such that the first and second resilient portions are resiliently biased towards each other to form the composite acoustic damping batten of the invention.

In a further embodiment of the invention, each complementary mating surface profile comprises at least one retaining formation. Conveniently, in one embodiment of the invention the at least one retaining formation comprises at least one protrusion on the second surface of the first resilient portion and a corresponding at least one recess on the first surface of the second resilient portion or vice versa. Advantageously, in this embodiment of the invention, the second face of the first resilient portion and the first face of the second resilient portion seat together such that the first and second resilient portions are resiliently biased towards each other to form the composite acoustic damping batten of the invention.

In a further embodiment of the invention, the at least two resilient portions comprise at least one pair of side edges. Conveniently, in one embodiment of the invention the at least one pair of side edges of the at least two resilient portions are spaced apart from each other on opposing sides of the resilient portions intermediate to and adjoining the first and second faces of the at least two resilient portions. In one embodiment of the invention the at least one pair of side edges optionally further comprise angled and/or profiled and/or stepped sections. In a further embodiment of the invention the at least one pair of side edges are configured to be functional side edges wherein the side edges of the at least two resilient portions are configured to include retaining means to restrain and/or lock the at least two resilient portions together.

Optionally in a further embodiment of the invention, the at least one pair of side edges comprise at least one fixing indicium. In a further embodiment of the invention, the at least one fixing indicium comprises any one of a surface marking, an indentation, notch or groove. In one embodiment of the invention, the fixing indicium comprises a continuous elongate indicium. In a further embodiment of the invention, the fixing indicium comprises a plurality of discrete indicia.

In one embodiment of the invention, the first building material is secured to the first resilient portion of the at least two resilient portions by fixing means, wherein the fixing means include any appropriate method known to the person skilled in the art, for example, any one of nailing, screwing, stapling or chemical fixing taken alone or in combination. In one embodiment of the invention, the first building material is secured to the first resilient portion wherein the first building material is in engaging contact with the first face of the first resilient portion and the fixing means are in communication with the first building material and the first resilient portion. In one embodiment of the invention, wherein the fixing means comprise nail or screw fixings, the nail or screw fixings are introduced through the first building material to the first resilient portion wherein the nail or screw fixings are retained in position. Conveniently, in this embodiment of the invention, the fixing means do not penetrate or communicate with the second resilient portion.

In a further embodiment of the invention, the second resilient portion is secured to the second building material by further fixing means, wherein the further fixing means include any appropriate method known to the person skilled in the art, for example, any one of nailing, screwing, stapling or chemical fixing taken alone or in combination. In one embodiment of the invention, the composite acoustic damping batten of the invention is secured to the second building material wherein the second building material is in engaging contact with the second face of the second resilient portion and the fixing means are in communication with the second building material and the second resilient portion.

In one embodiment of the invention, wherein the composite acoustic damping batten of the invention is secured to the second building material, for example, a building substructure and wherein the further fixing means comprise nail or screw fixings, the nail or screw fixings are introduced into either of the first or second resilient portions such that the further fixing means are spaced apart from and separate to the fixing means used to secure the first building material to the first resilient portion. Conveniently, where the nail or screw fixings are introduced into the first resilient portion, the nail or screw fixings penetrate the first resilient portion and the second resilient portion before being introduced into the second building material. In a further embodiment of the invention, the angle of the side edges of either or both of the first and second resilient portions is selected to control the angle of the nails or screw fixings.

The advantage of this embodiment of the invention is that the connection point and means by which the first building material is secured to the first resilient portion is completely separate to the connection point and means by which the second building material is secured to the second resilient portion. There is no opportunity for direct transmission of sound energy between the first and second building materials via fixing means. Accordingly, structure borne vibrations are reduced and/or minimised between the first face of the first resilient portion and the second face of the second resilient portion.

In a further embodiment of the invention there is further provided a retaining clip, for receiving and retaining at least one of the at least two resilient portions. Conveniently, in one embodiment of the invention the retaining clip is configured to receive and retain the second resilient portion.

In a further embodiment of the invention, the retaining clip comprises a central web, a pair of side arms each extending from a respective edge of the central web, a retaining formation adjacent the end of each of the pair of side arms, and at least one aperture in each side arm for receiving a fixing.

In one embodiment of the invention, the composite acoustic damping batten is configured for being disposed between a building sheet and a structural sub frame in a building construction. The advantage of this is that the composite acoustic damping batten of the invention is a batten by which a building sheet can be securely attached to a structural sub frame whilst minimising acoustic transmissions through the materials. Minimising or eliminating the noise transmissions through the batten of the invention thereby reduces noise transmissions between the interior rooms of the building and/or the exterior of the building.

It is also to be understood that the configuration of the composite acoustic damping batten of the invention could be reversed as required by the person skilled in the art.

Accordingly in a further embodiment of the invention, there is provided an composite acoustic damping batten, comprising:

- at least two resilient portions, each resilient portion comprising a first face and a second face, the at least two resilient portions being conjoined such that a first face of the first resilient portion and a second face of the second resilient portion are spaced apart from each other to form opposing external surfaces of the composite acoustic damping batten;
- wherein the first face of the first resilient portion is configured for contacting engagement with a second building material such that the second building material and the first resilient portion of the acoustic building element are securable together; and
- wherein the second face of the second resilient portion is configured for contacting engagement with a first building material such that the first building material and the second resilient portion of the acoustic building element are securable together.

In a further embodiment of the invention, the composite acoustic damping batten is sized to be equivalent to standard industry batten size. One advantage of aligning the dimensions of the composite acoustic damping batten of the invention to industry standards is to maintain familiarity for builders and installers used to working with standard dimension structural substrate elements such as timber studs and joists.

The invention will now be described more particularly with reference to the accompanying drawings, which show by way of example only a number of embodiments of the composite acoustic damping batten of the invention.

In the drawings,

FIG. 1*a* is a cross-sectional end view of a first resilient portion of the composite acoustic damping batten of the invention;

FIG. 1*b* is a cross-sectional end view of a second resilient portion of the composite acoustic damping batten of the invention;

FIG. 1*c* is a cross-sectional end view of the composite acoustic damping batten of the invention comprising the first and second resilient portions of FIGS. 1*a* and 1*b* respectively;

FIG. 1*d* is a cross-sectional perspective view of a section of the composite acoustic damping batten of FIG. 1*c;*

FIG. 2 is a cross-sectional end view of a building section constructed using the composite acoustic damping batten of FIGS. 1*c* and 1*d;*

FIG. 3*a* is a cross-sectional end view of a first resilient portion of a second embodiment of the composite acoustic damping batten of the invention;

FIG. 3*b* is a cross-sectional end view of a second resilient portion of the second embodiment of the composite acoustic damping batten of the invention;

FIG. 3*c* is a cross-sectional end view of the second embodiment of the composite acoustic damping batten of the invention comprising the first and second resilient portions of FIGS. 3*a* and 3*b* respectively;

FIG. 3*d* is a cross-sectional perspective view of a section of the composite acoustic damping batten of FIG. 3*c;*

FIG. 4 is a cross-sectional end view of a building section constructed using the second embodiment of the composite acoustic damping batten of FIGS. 3*c* and 3*d;*

FIG. 5*a* is a cross-sectional end view of a first resilient portion of a third embodiment of the composite acoustic damping batten of the invention;

FIG. 5*b* is a cross-sectional end view of a second resilient portion of the third embodiment of the composite acoustic damping batten of the invention;

FIG. 5*c* is a cross-sectional end view of the third embodiment of the composite acoustic damping batten of the invention comprising the first and second resilient portions of FIGS. 5*a* and 5*b* respectively;

FIG. 5*d* is a cross-sectional perspective view of a section of the composite acoustic damping batten of FIG. 5*c;*

FIG. 6*a* is a side view of a section of a retaining clip for use with the composite acoustic damping batten of the invention;

FIG. 6*b* is an end view of the retaining clip of FIG. 6*a;*

FIG. 7 is a cross-sectional end view of a building section constructed using the third embodiment of the composite acoustic damping batten of FIGS. 5*c* and 5*d* together with the retaining clip of FIGS. 6*a* and 6*b;*

FIG. 8*a* is a cross-sectional end view of a first resilient portion of a fourth embodiment of the composite acoustic damping batten of the invention;

FIG. 8*b* is a cross-sectional end view of a second resilient portion of the fourth embodiment of the composite acoustic damping batten of the invention;

FIG. 8*c* is a cross-sectional end view of the fourth embodiment of the composite acoustic damping batten of the invention comprising the first and second resilient portions of FIGS. 8*a* and 8*b* respectively;

FIG. 8*d* is a cross-sectional perspective view of a section of the composite acoustic damping batten of FIG. 8*c;*

FIG. 9 is a cross-sectional end view of a building section constructed using the fourth embodiment of the composite acoustic damping batten of FIGS. 8*c* and 8*d* together with the retaining clip of the invention;

FIG. 10*a* is a cross-sectional end view of a first resilient portion of a fifth embodiment of the composite acoustic damping batten of the invention;

FIG. 10*b* is a cross-sectional end view of a second resilient portion of the fifth embodiment of the composite acoustic damping batten of the invention;

FIG. 10*c* is a cross-sectional end view of the fifth embodiment of the composite acoustic damping batten of the invention comprising the first and second resilient portions of FIGS. 10*a* and 10*b* respectively;

FIG. 11*a* is a cross-sectional end view of a building section constructed using the fifth embodiment of the composite acoustic damping batten of FIGS. 10*c* and 10*d* together with the retaining clip of FIGS. 6*a* and 6*b* in place on a normal width beam;

FIG. 11*b* is a cross-sectional end view of a building section constructed using the fifth embodiment of the composite acoustic damping batten of FIGS. 10*c* and 10*d* together with the retaining clip of FIG. 6*b* in place on a narrow beam;

For ease of reference, like components across each embodiment of the composite acoustic damping batten of the invention have been allocated the same reference numeral in each described embodiment.

Figure 1A:
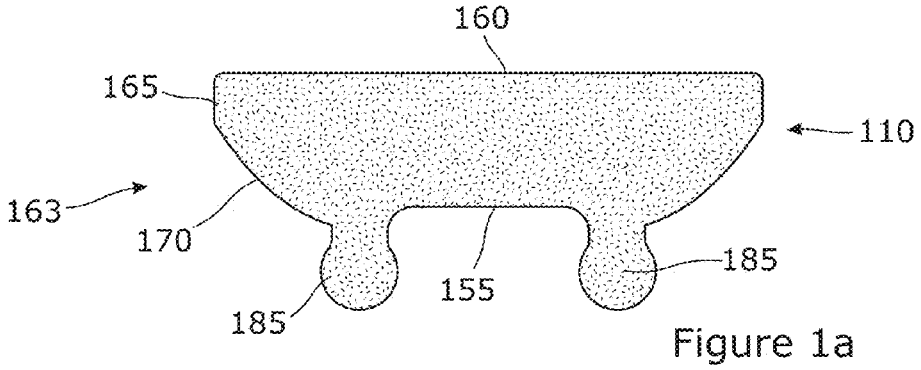
Figure 1B:
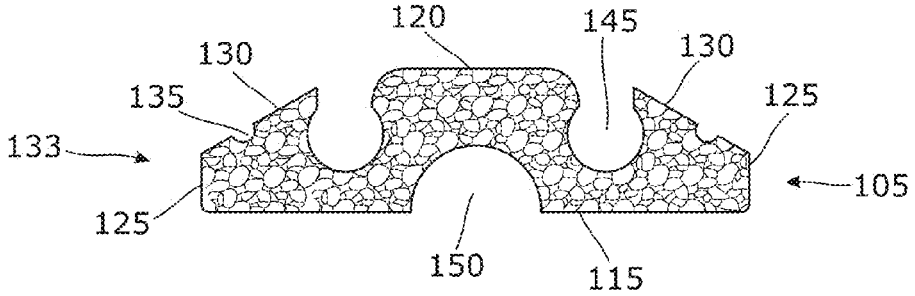

Referring to FIGS. 1*a* to 1*d*, there is shown a first embodiment of the composite acoustic damping batten 100 of the invention comprising a first resilient portion 110 of FIG. 1*a* and a second resilient portion 105 of FIG. 1*b*. First resilient portion 110 and second resilient portion 105 are designed to resiliently engage with each other to form the composite acoustic damping batten 100 of FIGS. 1*c* and 1*d*. In the embodiment shown first resilient portion 110 and second resilient portion 105 are formed separately and can be connected prior to or during installation to form the composite acoustic damping batten 100.

As shown in FIGS. 1*a* and 1*b*, first resilient portion 110 comprises a first face 160, a second face 155 and a pair of spaced apart side faces 163 wherein the side faces 163 adjoin each of the first and second faces 160 and 155 to form a continuous profile. In the embodiment shown, each of side faces 163 comprises a planar section 165 and a curved section 170. Second resilient portion 105 comprises a first face 120 and a second face 115 and a pair of spaced apart angled side faces 133. Each of angled side faces 133 comprises a planar section 125 and an angled section 130.

Figure 1C:
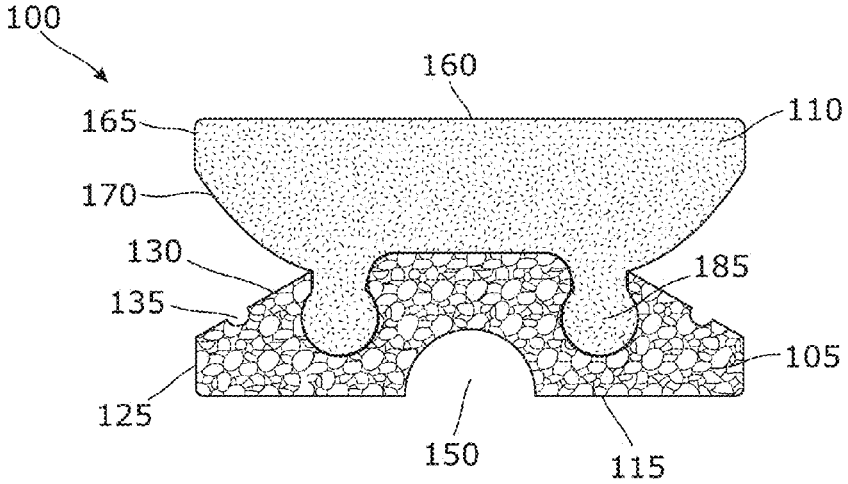
Figure 1D:
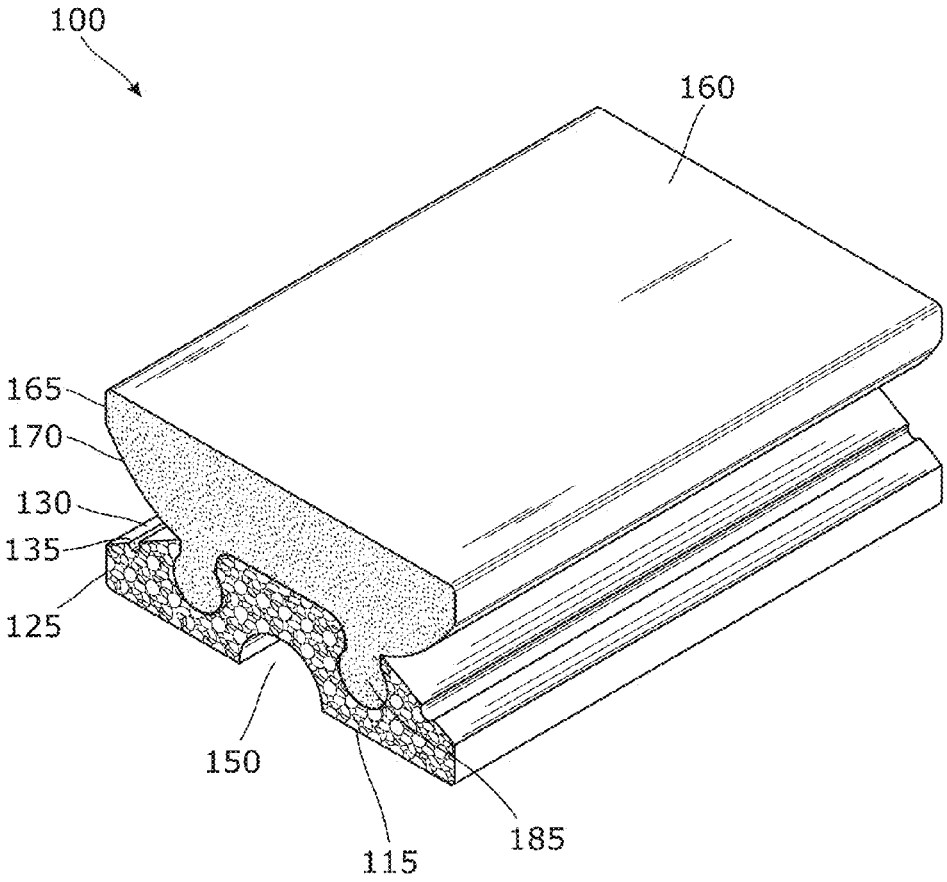

First resilient portion 110 and second resilient portion 105 each further comprise retaining formations wherein the first resilient portion 110 comprises protrusions 185 which are spaced apart from each other and project from the second face 155 of first resilient portion 110. Second resilient portion 105 comprises recesses 145 intermediate the first face 120 and the angled sections 130 which are designed to accommodate and constrain the protrusions 185 of first resilient portion 105. Specifically, in this embodiment of the invention, the protrusions 185 of first resilient portion 105 have a bulbous profile whereby the neck of the protrusion is substantially narrower than the rounded section extending therefrom. The edges of each recess 145 adjacent the angled section 130 and the first face 120 are provided with a limited degree of freedom of movement to allow the protrusions 185 to seat within the recesses such that the edges of the recesses 145 are positioned at the neck of each protrusion 185 to retain or lock the protrusion 185 within the recess 145 as shown in FIGS. 1*c* and 1*d*.

Furthermore in the embodiment shown, the configuration of protrusions 185 and recesses 145 also act to locate and lock the second faces 155 and 120 in a juxtaposed position when the resilient portions 105 and 110 are conjoined and the protrusions 185 are fully seated within the recesses 145 such that first face 160 of the first resilient portion 110 and second face 115 of the second resilient portion 105 form opposing external faces of the composite acoustic damping batten.

Figure 2:
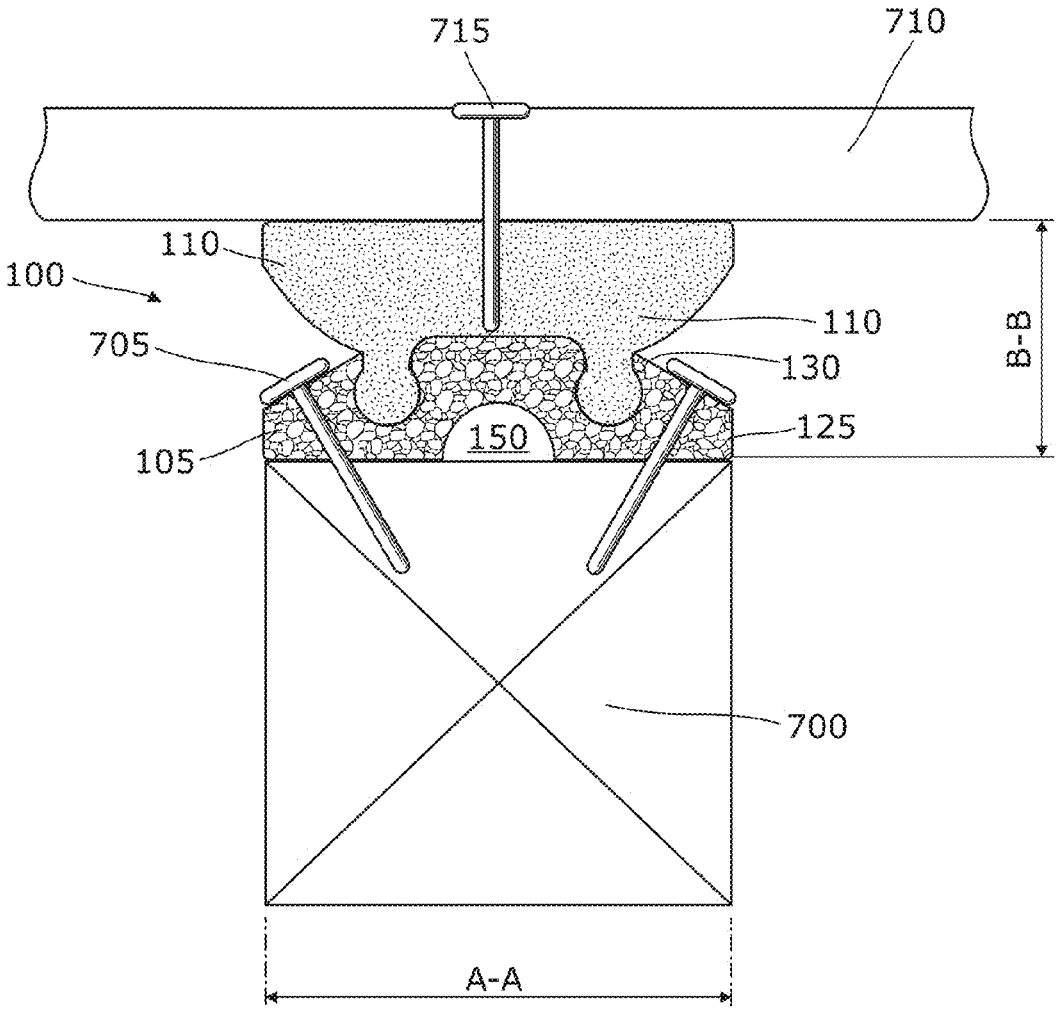

Referring now to FIG. 2, first face 160 of first resilient portion 110 is configured for contacting engagement with a first building material, for example, a building sheet 710. Second face 115 of second resilient portions 105 is configured for contacting engagement with a second building material, for example, a structural substrate or subframe 700. Composite acoustic damping batten 100 is sized to be equivalent to standard industry batten size. It is to be understood that the composite acoustic damping batten of the invention is not limited to this size and can be sized and shaped as required by a person skilled in the art. In the embodiment shown, the width A-A of the first face 160 is approximately 50 mm. This width is relatively similar to that of the second face 115 which in turn is equivalent to the width of the substrate 700, in this example, a standard timber or steel framing stud. Conveniently width A-A is sufficiently wide to allow for fixing zones of two adjacent building sheets into a single composite acoustic damping batten of the invention. Other standard widths, such as 35 mm, 45 mm, 60 mm, 70 mm, 75 mm, 100 mm and so on may also be provided without altering the scope of the invention. In the embodiment shown in FIGS. 1*a* to 2, the height B-B of the composite acoustic damping batten 100 is approximately 13 mm. It is also possible to use other heights as appropriate for different configurations of the composite acoustic damping batten of the invention or a required by the person skilled in the art.

One advantage of aligning the dimensions of the composite acoustic damping batten of the invention to industry standards is to maintain familiarity for builders and installers used to working with standard dimension structural substrate elements such as timber studs and joists.

At least one of the first and second resilient portions of each of the embodiments of the composite acoustic damping battens shown may be formed from a range of resilient materials, preferably polymeric materials. Suitable polymeric materials include the family of elastomeric materials and the family of expandable polymeric materials. In this embodiment of the invention, first resilient portion 110 is formed from a synthetic rubber having a Shore A hardness of approximately 50. This is within the range of Shore A hardness levels which are deemed to have sufficient strength to support a building sheet whilst being able to deform slightly during installation to conform to any irregularities in either the building sheet 710 or the structural substrate 700. Conveniently this level of hardness is also sufficient to provide the required nail holding strength without cracking, splitting, deforming, bending and the like.

Second resilient portion 105 is formed from an elastomeric synthetic rubber having a Shore A hardness of approximately 70. The higher hardness value of the second resilient portion 105 relative to the first resilient portion 110 enables the second resilient portion 105 to have sufficient strength to secure the composite acoustic damping batten 100 to structural substrate 700 without deforming significantly under load whilst providing enhanced acoustic isolation and decoupling of the installation.

Conveniently in this particular embodiment of the invention, the material of the first resilient portion 110 also allows a user to assemble the composite acoustic damping batten 100. The first resilient portion 110 is sufficiently malleable to allow the protrusions 185 to deform and insert into the recesses of 145 as an external force is applied to the first resilient portion 110. In practice, a user places the first resilient portion 110 adjacent the second resilient portion 105 so that the protrusions 185 and recesses 145 are aligned and then simply press the two resilient portions 110 and 105 together such that the protrusions 185 snap into recesses 145.

Other suitable elastomeric materials or synthetic rubbers may be selected from the group comprising natural rubber, synthetic rubbers, gutta percha, styrene-butadiene rubbers, nitrile rubbers, polybutadiene rubbers, chloroprene rubbers, isoprene rubbers, halogenated butyl rubbers, ethylene propylene rubber, ethylene propylene diene rubbers, epichlorhydrin rubbers, polyacrylic rubbers, fluoroelastomers, perfluoroelastomers, silicone rubbers, and polyether block amides (PEBA's). Suitable materials may include new and/or recycled materials having the appropriate Shore A hardness values.

Building sheet 710 is secured to first resilient portion 110 using fixing means 715. In the embodiment shown, fixing means 715 is positioned in the centre of the width A-A however it is to be understood that the position of fixing means 715 within the first resilient portion 110 could be altered to accommodate further building sheets. Fixing means 715 is sized such that it does not penetrate second resilient portion 105. In use, fixing means include any appropriate method known to the person skilled in the art, for example, any one of nailing, screwing, stapling or chemical fixing taken alone or in combination. Typically, the composite acoustic damping batten 100 of the invention would be installed by the most commonly used technique of nailing or screwing.

Second resilient portion 105 further comprises a pair of spaced apart angled side edges 130, each of which are provided with an indentation or notch 135. Notch 135 functions as a fixing indicium for end-users, accordingly, can be present as a continuous elongate indicium or as a plurality of discrete indicia. In the present embodiment the indicium is in the form of a continuous elongate indentation. Fixing means 705 are used to secure the second resilient portion 105 to the structural substrate 700. In practice, fixing means 705 are positioned spaced apart from each other along the elongate indentation or notch 135 and are introduced to the structural substrate 700 via the second resilient portion 105. Conveniently, the angle of side edges 130 is selected to control the angle of the nails or screw fixings. The angle is carefully selected to ensure that fixing of the acoustic damping resilient element 100 to the structural substrate is achieved without interfering with the first resilient portion 110.

Second face 115 of second resilient portion 105 further comprises a recess 150. Recess 150 enables the second resilient portion 105 to accommodate a certain amount of deformation which could occur during fixing. This is particularly relevant when a material of higher Shore A hardness is used in the second resilient portion 105 relative to the Shore A hardness value of the material of the first resilient portion 110. Recess 150 allows the resilient portion 105 to compress when under load conditions whilst preventing or limiting the degree with which the material will bunch up or bulge at other places. This in turn ensures that the first surface 120 of the second resilient portion 105 remains substantially undeformed. Accordingly, the integrity of the connection between the first and second resilient portions 110 and 105 is maintained, as are the mechanical and acoustic damping properties of the composite acoustic damping batten of the invention.

In FIG. 2, the connection point and means by which the first building material, building sheet 710 is connected to the first resilient portion 105 of the composite acoustic damping batten 100 is completely separate to the connection point and means by which the second building material, for example, the structural substrate or subframe 700 is connected to the second resilient portion 110 of the composite acoustic damping batten 100. The resilient portions are also formed from material that absorbs or dissipates sound energy. Accordingly, structure borne vibrations are reduced and/or minimised between the first face 160 of the first resilient portion 110 and the second face 115 of the second resilient portion 105. There is no opportunity for direct transmission of sound energy between the first and second materials, thus the acoustic batten of the invention 100 also functions as an composite acoustic damping batten.

The combination of judicious selection of materials having both acoustic damping and mechanical strength properties, fixing a building sheet 710 to the first resilient portion 110 of composite acoustic damping batten 100 only and fixing composite acoustic damping batten 100 to structural substrate 700 through side edges 130 of second resilient portion 105 provides a unique combination of acoustic damping, mechanical strength and ease of installation.

Figure 3A:
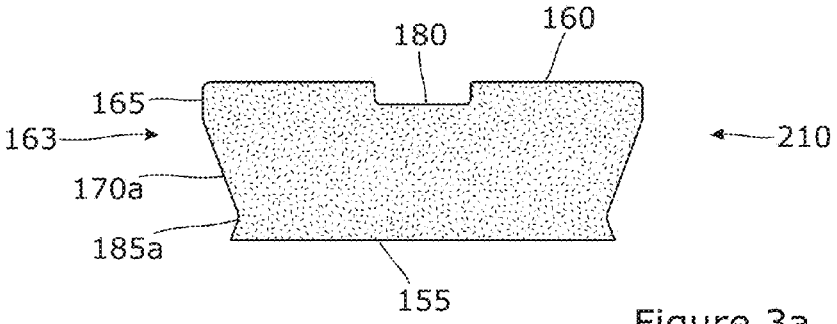
Figure 3B:
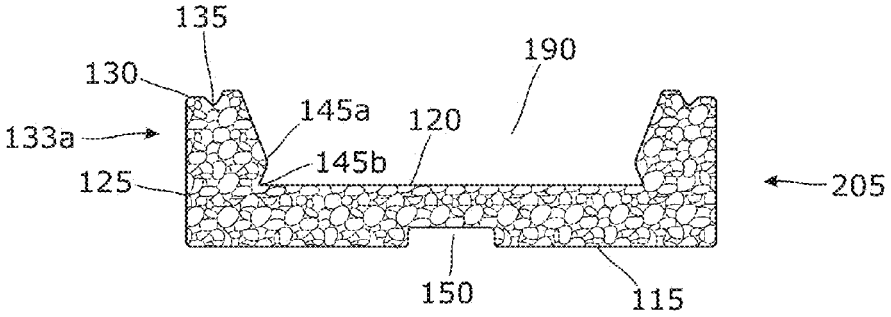
Figure 3C:
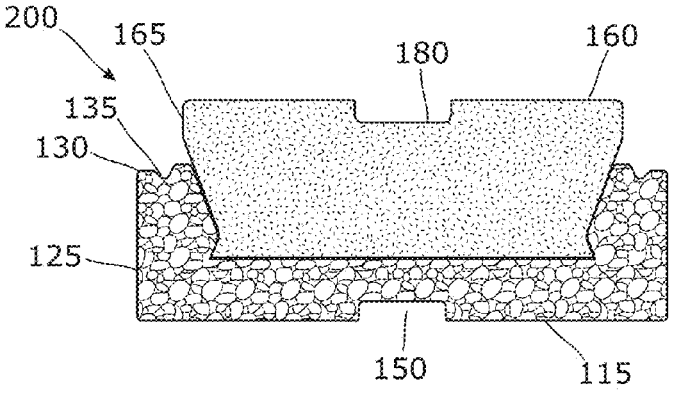
Figure 3D:
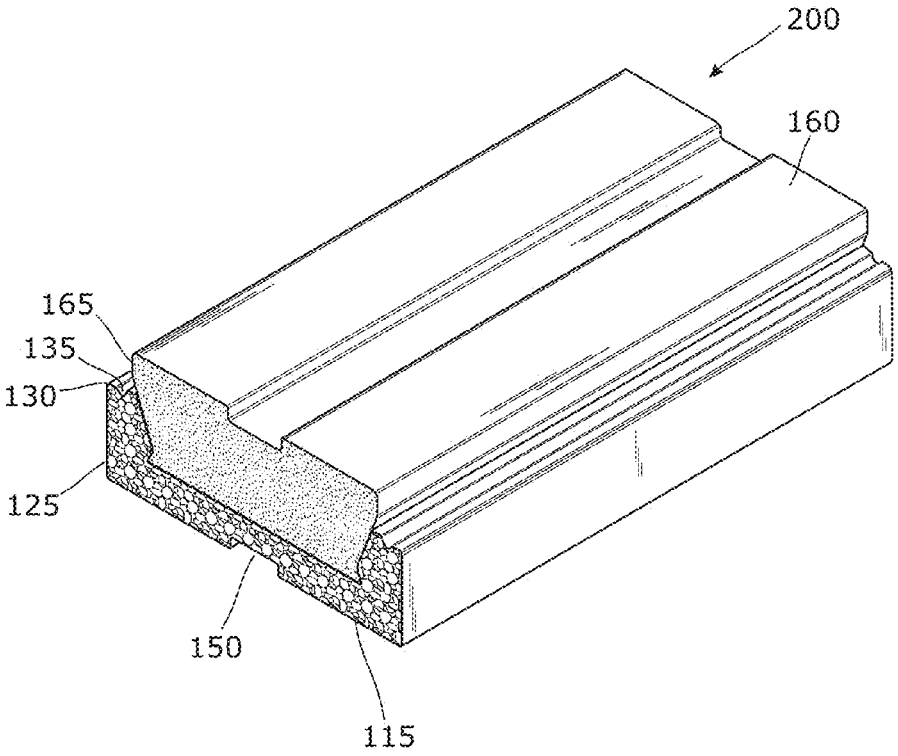

Referring now to FIGS. 3*a* to 3*d*, there is shown a second embodiment of the composite acoustic damping batten 200. Second embodiment of the composite acoustic damping batten 200 comprises a first resilient portion 210 as shown in FIG. 3*a* and a second resilient portion 205 as shown in FIG. 3*b* which are conjoined to form composite acoustic damping batten 200.

As shown in FIGS. 3*a* and 3*b*, first resilient portion 210 comprises a first face 160, a second face 155 and a pair of spaced apart side faces 163 wherein the side faces 163 adjoin each of the first and second faces 160 and 155 to form a continuous profile. In the embodiment shown, each of side faces 163 comprises a planar section 165 and an angled section 170*a*. Angled section 170*a* further comprises a retaining formation 185*a*. The first face 160 of first resilient portion 210 further comprises an elongate recess 180.

Second resilient portion 205 comprises a first face 120 and a second face 115 and a pair of spaced apart side arms 133*a*. Side arms 133*a* project from first face 120 such that the second resilient portion 205 comprises a substantially U-shaped channel 190. Each of side arms 133*a* comprise a substantially planar section 125, an angled section 130 and a retaining section 145*a*. Retaining section 145*a* is provided with complementary shaped surface profiling in the form of recesses 145*b* which are designed to accommodate and constrain the retaining formations 185*a* of first resilient portion 205 when retaining formations 185*a* are seated within the recesses 145*b*. Side arms 133*a* each include indicia in the form of an indentation 135. As per the first embodiment of the composite acoustic damping batten of the invention, the second face 115 of second resilient portion 205 further comprises a recess 150.

In a similar way to the first embodiment of the composite acoustic damping batten, the configuration of retaining formations 185*a* and recesses 145*b* also act to locate and lock the second faces 155 and 120 in a juxtaposed position when the resilient portions 105 and 110 are conjoined and the first resilient portion 210 is seated within the substantially U-shaped channel 190 of the second resilient portion 205.

In the embodiment shown in FIGS. 3*a* to 3*d*, first resilient portion 205 is formed from a foamed synthetic ethylene propylene diene monomer (EPDM) rubber having a Shore hardness of 50. Second resilient portion 210 is formed from a synthetic EPDM rubber having a Shore hardness of 70.

Figure 4:
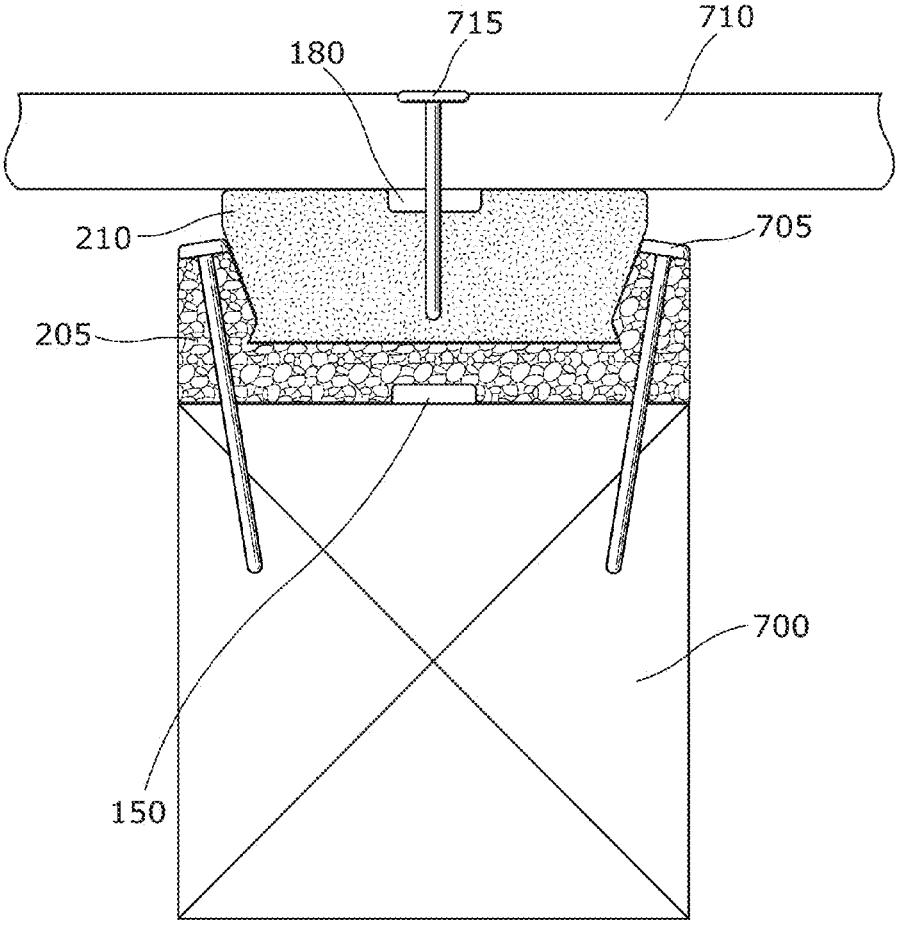

Referring now to FIG. 4, there is shown a section of the second embodiment of the composite acoustic damping batten of the invention 200 in a building construction. First resilient portion 210 is configured for contacting engagement with building sheet 710. Building sheet 710 is secured to the first resilient portion 210 using fixing means 715. Second resilient portion 205 has been fixed to structural substrate or subframe 700 by nails 705. The angle at which nails 705 are introduced into resilient portion 205 and subsequently substrate 700 is controlled by the angle at which side arm 133*a* projects from the first face 120. Recesses 150 and 180 in the second and first resilient portions 201 and 210 respectively, each provide means by which the composite acoustic damping batten of the invention can accommodate a certain amount of deformation during fixing and/or loading.

Referring now to FIGS. 5*a* to 5*d*, there is shown a third embodiment of the composite acoustic damping batten 300 of the invention. Composite acoustic damping batten 300 is formed by co-extruding the at least two different resilient portions 305 and 310 together wherein the first face 120 of the second resilient portion 305 is permanently connected to the second face 155 of the first resilient portion 110. As in the previous embodiment, first and second resilient portions 310 and 305 are formed from EPDM rubber, wherein the EPDM rubber of the first resilient portion 310 has been foamed to provide a lower Shore hardness value than that of the non-foamed second resilient portion 305. In this embodiment, first resilient portion 310 is formed at a Shore A hardness durometer value of approximately 40, whereas second resilient portion 310 is formed at a Shore A hardness durometer value of approximately 70. Ideally, the composite acoustic damping batten 300 can be prepared in various lengths, for example, 3 meters, 4 meters, 5 meters, 6 meters and so on so that a single length may span the entire width or length of a room without requiring any joining. Alternatively, the composite acoustic damping batten 300 may be extruded as a longer roll and cut to size on site as required.

Figure 5A:
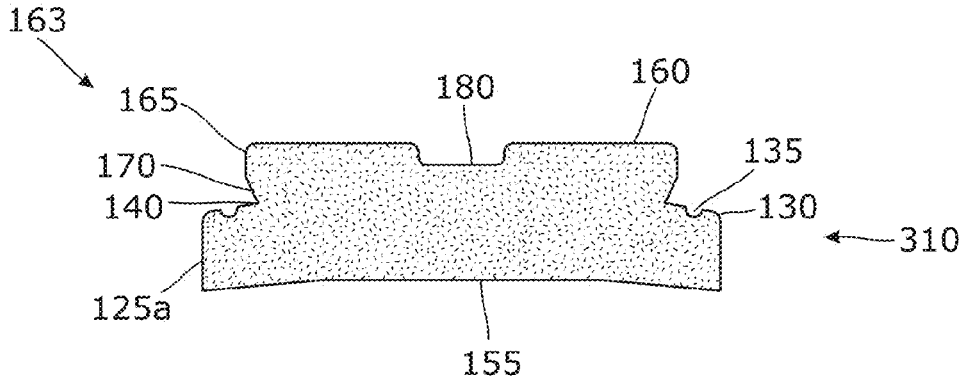
Figure 5B:
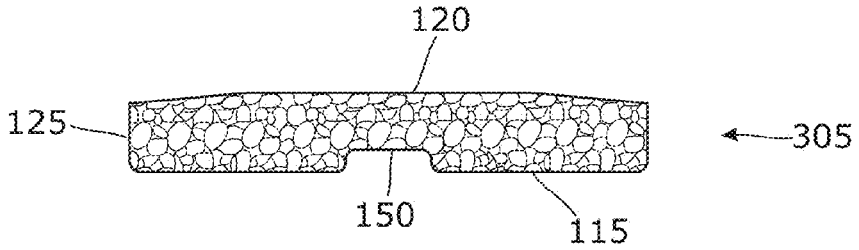
Figure 5C:
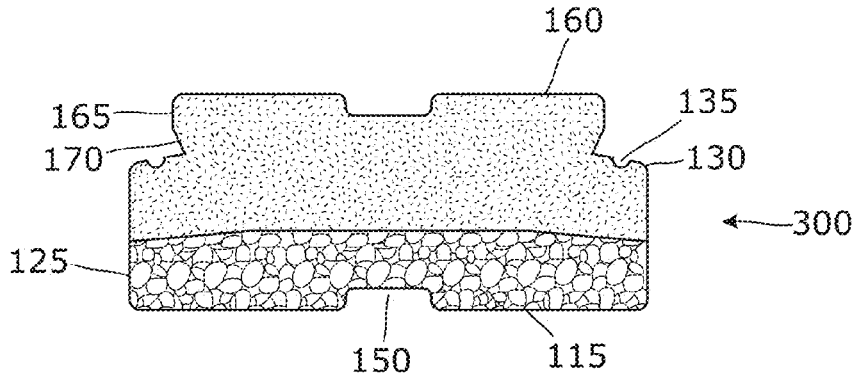
Figure 5D:
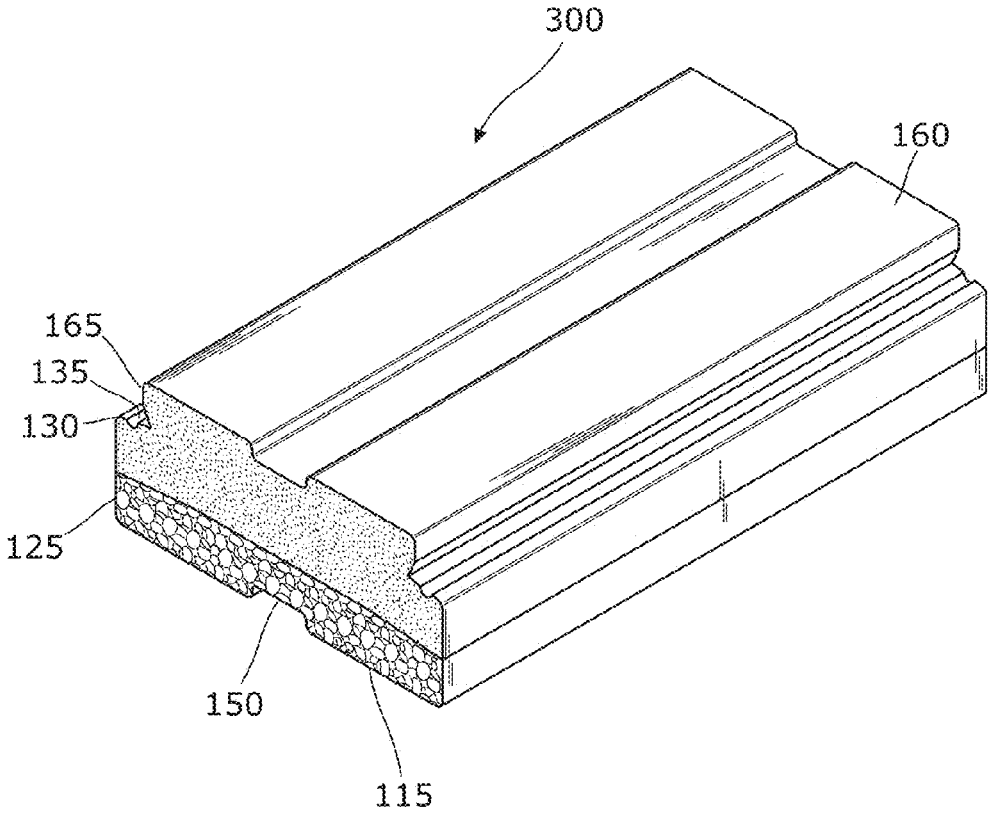

Referring specifically to FIG. 5*a*, the third embodiment of the first resilient portion 310 is shown comprising side edges 163. Each of side edges 163 include a plurality of planar portions 125*a* and 165 together with angled portions 130 and 170. The portions 125, 165, 130 and 170 are arranged together to create a recess 140 for accepting a retaining formation on a retaining clip or the head of fixing means such as a nail. Side edges 163 also include a fixing guide in the form of groove 135. The remaining features of the first and second resilient portions 305 and 310 are as described above for the first and second embodiments of the invention.

Figure 10A:
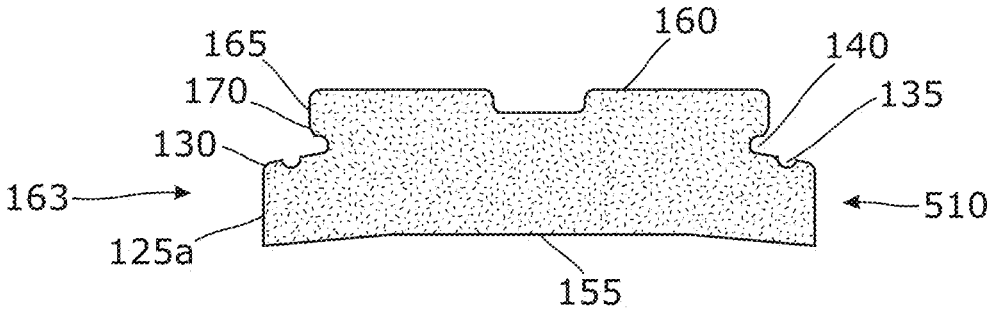
Figure 10B:
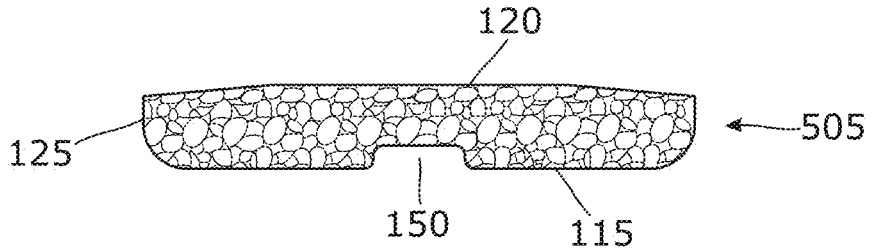
Figure 10C:
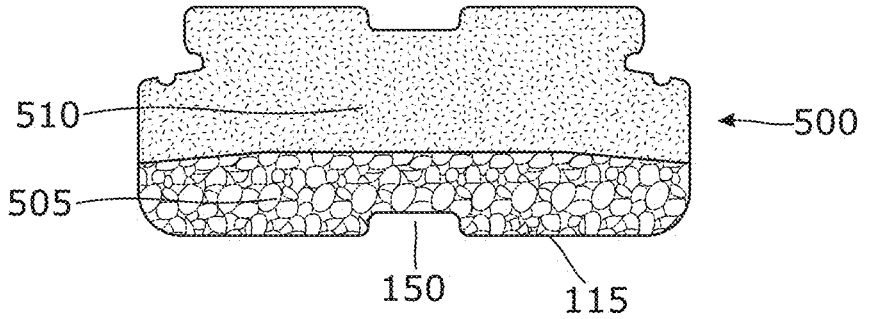

Referring now to FIGS. 8*a* to 8*d* and 10*a* to 10*c*, there is shown fourth and fifth embodiments of the composite acoustic damping batten of the invention 400 and 500 respectively. The fourth embodiment of the composite acoustic damping batten of the invention as shown in FIGS. 8*a* to 8*d* is similar to the second embodiment 200 of the composite acoustic damping batten of the invention as shown in FIGS. 3*a* to 3*d* varying only in the configuration of the side edges 163. In the fourth embodiment of the composite acoustic damping batten 400 a recess 140 is provided in the side edge 163 to facilitate the placement of fixing means such as a nail or screw. In a similar way, the fifth embodiment of the composite acoustic damping batten 500 as shown in FIGS. 10*a* to 10*c* is similar to the third embodiment 300 of the composite acoustic damping batten of the invention as shown in FIGS. 4*a* to 4*d* varying only in the configuration of the side edges 163. In the fifth embodiment of the composite acoustic damping batten 500 recess 140 takes the form of an indentation or notch in the side edge 163 to facilitate the placement of fixing means such as a nail or screw.

Figure 6A:
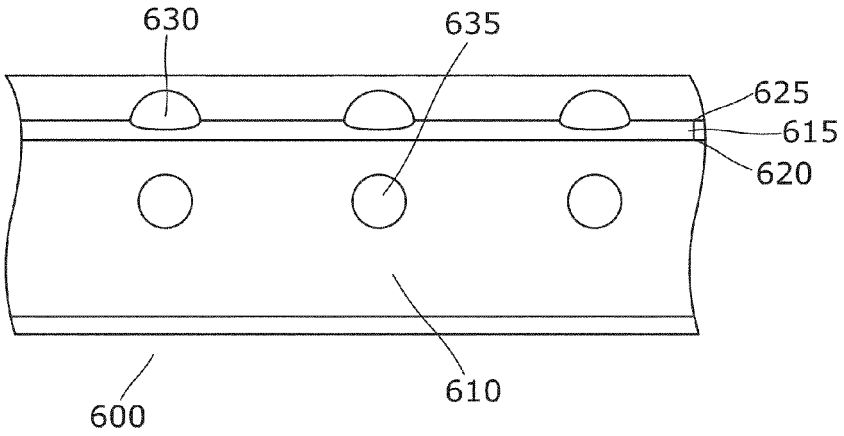
Figure 6B:
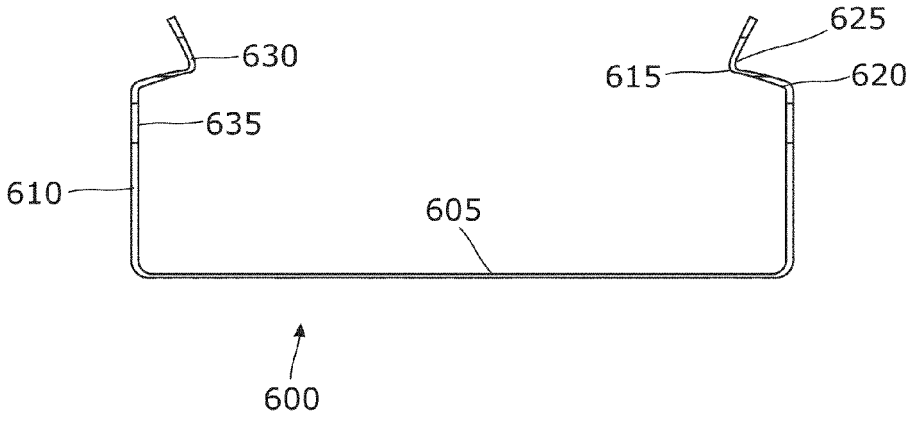

FIGS. 6*a* and 6*b* show a retaining clip 600 which may be used in conjunction with any of the second to fifth embodiments of the composite acoustic damping batten of the invention. The advantage of retaining clip 600 is that it will improve stability of the composite acoustic damping batten of the invention during fixing whilst retaining acoustic damping properties. Retaining clip 600 comprises a central web 605, a pair of side arms 610 each extending perpendicularly from a respective side edge of central web 605. In this embodiment, a substantially "V" shaped retaining formation 615 is formed at the end of each side arm 610 remote from the central web 605 wherein the central point of the "V" 615 is directed inwards towards the symmetrical axis of the retaining clip 600. The central point of the "V" 615 is formed at the junction between planar sections 620, 625.

Retaining clip 600 can be sized to any length as desired by the end user, for example, retaining clip 600 may be in the form of a plurality of discrete clips of predetermined length or in the form of an elongate section of desired length which can subsequently be cut into discrete shorter sections for use an individual clips is so desired. Retaining clip 600 may be formed from metal or polymeric materials, but typically would be made from a metal such as aluminium or steel. Retaining clip 600 may be formed by extrusion or by folding or by any other process known to a person skilled in the art. For example, a galvanised or zincalume steel sheet 0.6 mm thick, may be folded to provide a central web approximately 60 mm wide and a pair of side arms each approximately 25 mm in length and extending perpendicularly from a respective edge of the central web. At approximately 17 mm from the central web 605, each side arm 610 is folded inwardly towards the central web 605 to form an interior angle of approximately 105 degrees to the side arm. Each side arm is folded again at approximately 6-7 mm further along to form a substantially "V" shaped formation. The top arm 625 of the "V" is approximately 4-5 mm long and forms an angle of approximately 80 degrees between the arms of the "V" shaped formation 625 and 620 respectively. Dimensions of the retaining clip will vary with width, height, thickness, fold locations and fold angles to suit varying installation requirements.

One or more series of apertures 630, 635 may be formed in retaining clip 600 by drilling, punching and the like. If retaining clip 600 is formed by folding a metal sheet, apertures 630, 635 may be formed prior to the folding operation. These apertures may be spaced apart from each other at convenient distances, for example, at distances ranging between approximately 20 mm to 200 mm, preferably between 20 mm to 50 mm, and more preferably at approximately 20 mm. The angle at which the side arm is bent inwards provide a guide for a nailing gun to control the angle at which nails or screws will enter the resilient portion of the composite acoustic damping batten and subsequently, the structural substrate.

Apertures 630 extend through planar sections 620, 625 of the "V" shaped formation. Apertures 630 may be used to fix the composite acoustic damping batten of the invention to the structural substrate, where the width of the structural substrate is greater than or equivalent to the width of central web 605. Apertures 635 formed in side arms 610 of retaining clip 600 are provided for use when it is intended secure the composite acoustic damping batten of the invention to a narrow structural substrate element such as a narrow stud; joist or "I" beam. In use, apertures 630 in the longer arm 620 of the "V" section allows fixings to enter the batten at a predefined angle, whilst the aperture in the shorter arm 625 of the "V" shaped section allows for the nail head to seat flat against an angled side arm portion 130 of the first resilient portion. By using the apertures as a fixing guide, the angle at which the nails or screws are introduced into the composite acoustic damping batten of the invention and subsequently into the structural substrate can be altered to optimize the mechanical strength and stability of the fixing. Apertures of 5-7 mm are suitable for allowing some freedom of entry of the angle of the fixings.

Figure 7:
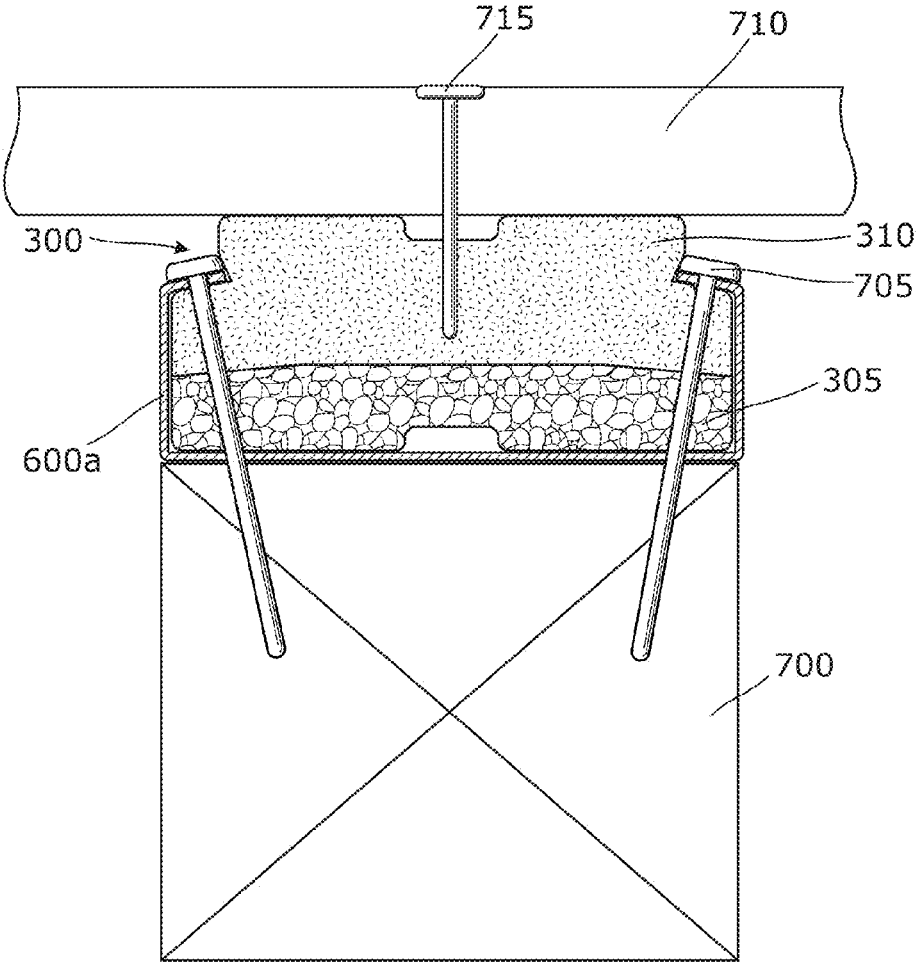
Figure 8A:
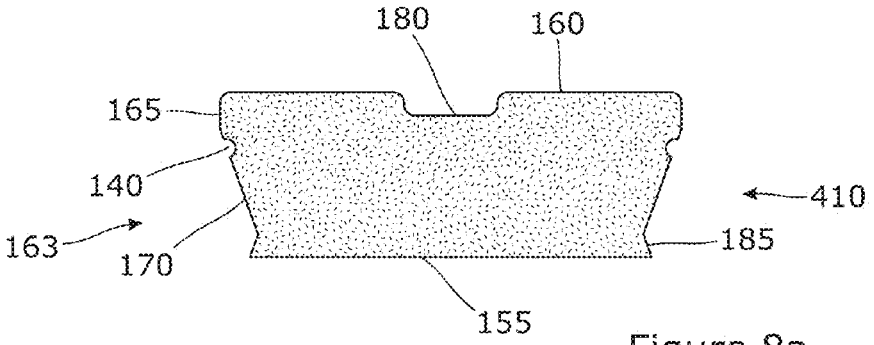
Figure 8B:
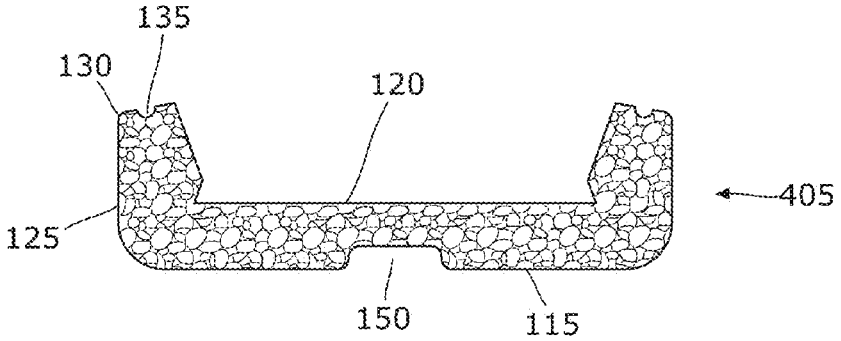
Figure 8C:
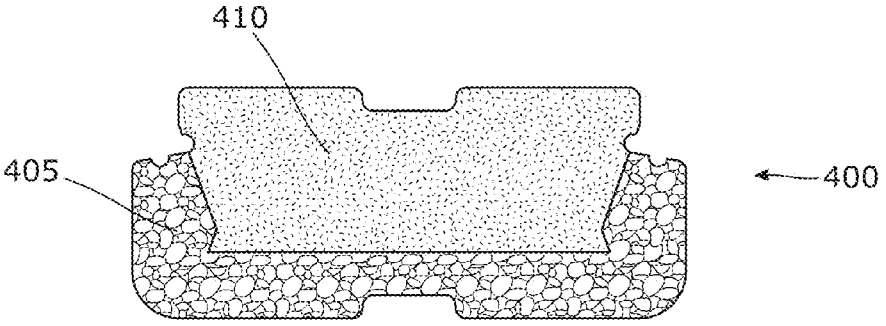
Figure 8D:
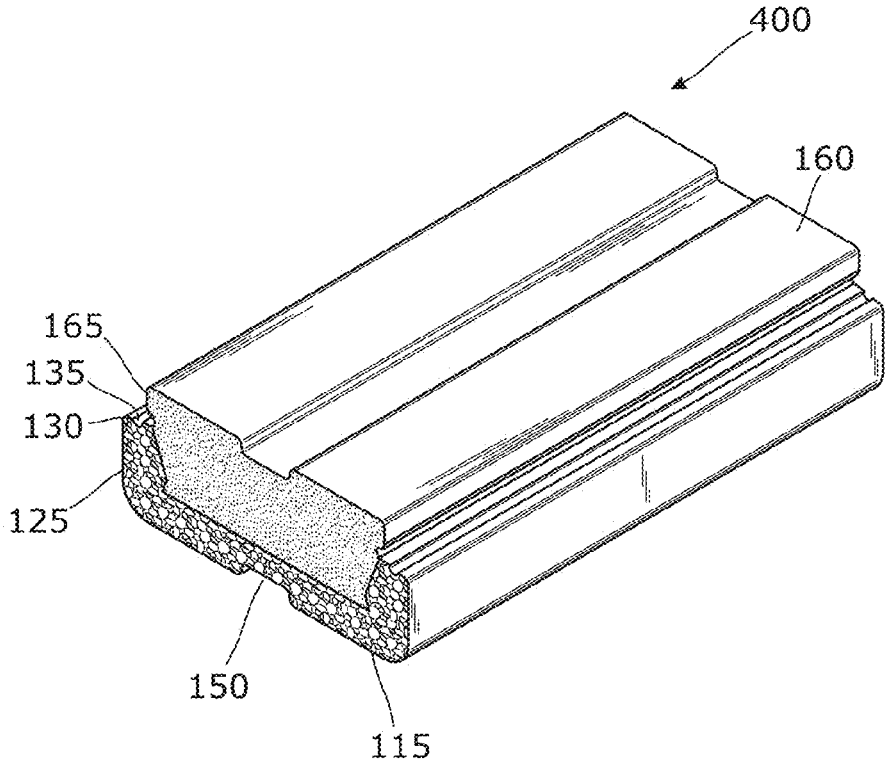
Figure 9:
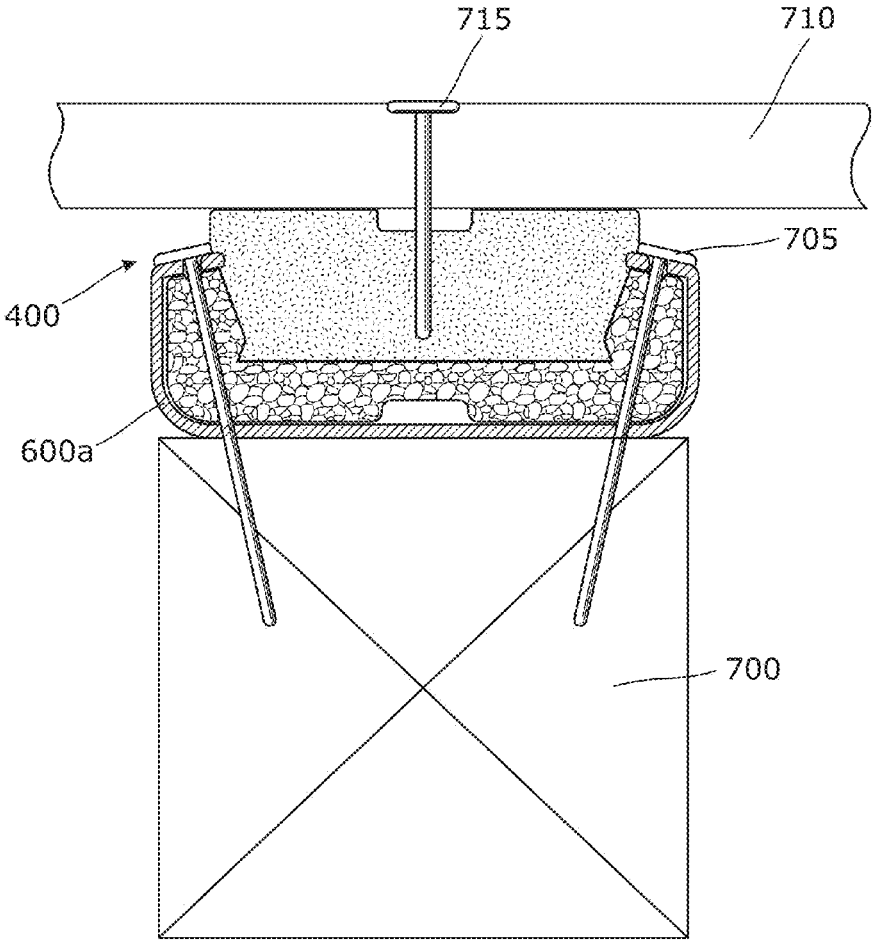

Referring now to FIGS. 7 and 9, there is shown a building section constructed using composite acoustic damping batten 300 and 400 respectively together with retaining clip of the invention 600*a*. Retaining clip 600*a* differs from retaining clip 600 only in that the formation at the end of side arms 610 remote from the central web 605 comprises a planar section directed inwards from each respective side arm 610. In the drawings, composite acoustic damping batten 300 or 400 comprising first and second resilient portions 310, 410 and 305, 405 respectively are inserted into a corresponding formed length of clip 600*a*. Retaining formations 615 on side arms 610 of retaining clip 600*a* each engage with recess 140 in side edges 163 of composite acoustic damping batten 300 or 400. In the building section shown each of composite acoustic damping batten 300, 400 is positioned on structural substrate 700 and fixed thereto by nails 705 introduced through a pair of side edges 163.

Referring specifically to FIG. 7, nails 705 are positioned such that they are introduced to first resilient portion 310 at a predetermined angle through fixing indicia 135. The angle at which fixing means 705 enters the first resilient portion is determined by angled portion 130. Fixings 705 travel through first and second resilient portions 310 and 305 respectively and exit through central web 605 of clip 600*a* and into structural substrate 700.

In contrast, in the fourth embodiment of the composite acoustic damping batten of the invention as shown in FIG. 9, nails 705 are introduced directly into second resilient portion 410 before exiting the central web 605 of clip 600*a* and into structural substrate 700. Again, the angle at which fixing means 705 enters the second resilient portion 410 is determined by angled portion 130.

In both FIGS. 7 and 9, the connection point and means by which the first material or building sheet 710 is connected to the first resilient portion 305, 405 of the composite acoustic damping batten 300, 400 is completely separate to the connection point and means by which the second material or the structural substrate 700 is connected to the second resilient portion 310, 410 of the composite acoustic damping batten 300, 400. The resilient portions are formed from a synthetic material that absorbs or dissipates sound energy. Accordingly, structure borne vibrations are reduced and/or minimised between the first face 160 of the first resilient portion 310, 410 and the second face 115 of the second resilient portion 305, 405. There is no opportunity for direct transmission of sound energy between the first and second materials, thus the composite acoustic damping batten of the invention 300, 400 functions as a composite acoustic damping batten. Each of composite acoustic damping battens of the invention function in this way.

Figure 11A:
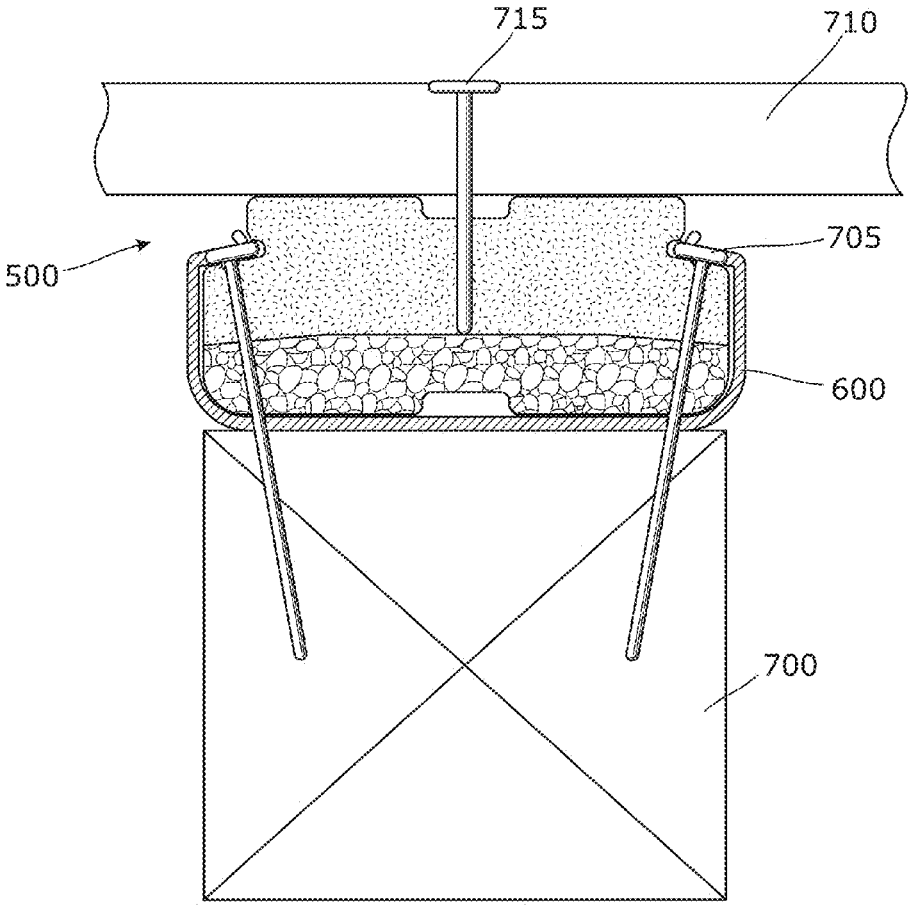
Figure 11B:
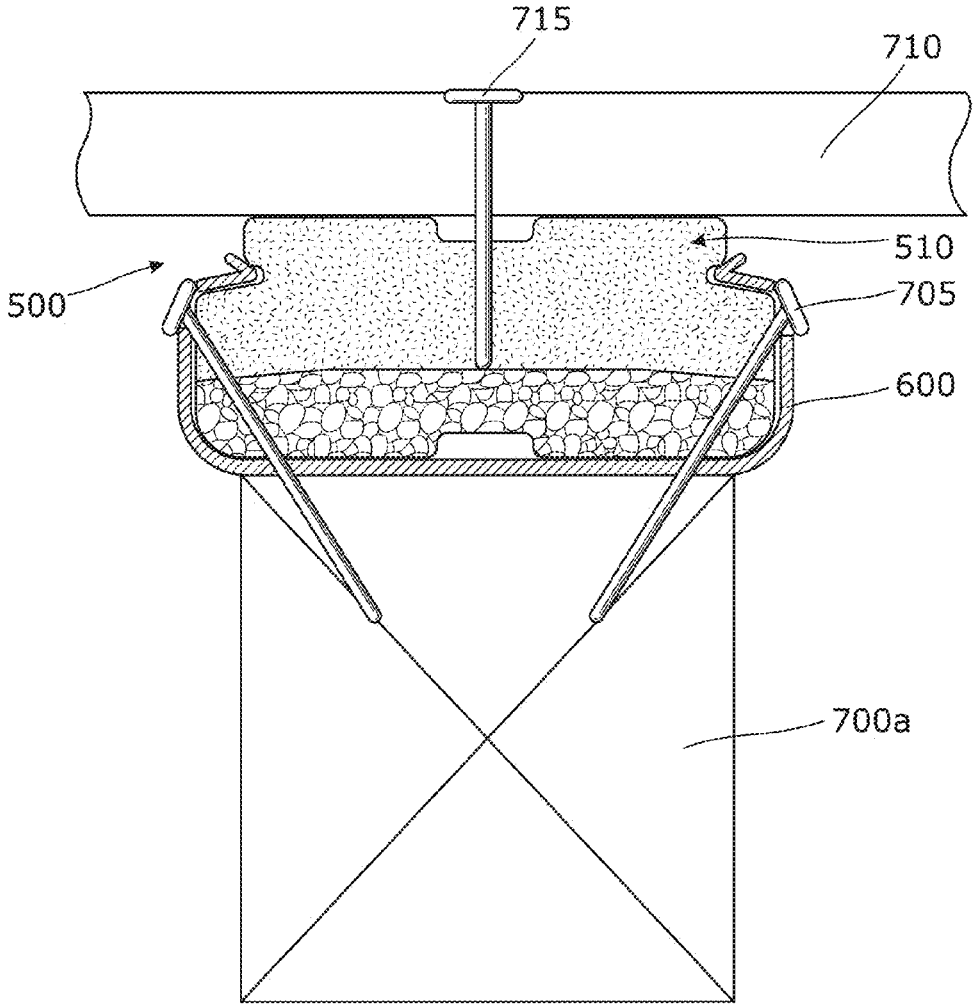

Referring now to FIGS. 11*a* and 11*b*, there is shown is a cross-sectional end view of a building section constructed using the fifth embodiment of the composite acoustic damping batten 500 of FIG. 10*c* and retaining clip 600 of FIGS. 6*a* and 6*b*. In FIG. 11*a* the building section comprises a substrate which is a normal width beam 700, whilst in FIG. 11*b* the building section comprises a substrate which is a narrow beam 700*a*. Fixing means 705 have been placed in different apertures on the retaining clip 600 to ensure secure fixing to beams 700 and 700*a*.

It is to be understood that, clips 600 or 600*a* prevent distortion of composite acoustic damping batten of the invention through uneven or irregular fixing by an installer, and may serve to overcome issues with the structural substrate, but are not essential to the invention.

Although not shown, it should also be understood that it is possible to use further mechanical or chemical fixing means as a secondary securing means to secure the composite acoustic damping batten with or without the presence of the retaining clips of the invention. For example, in one embodiment of the invention, glue could be used as a secondary fixing means to secure the composite acoustic damping batten to either the first or second building material Referring now to FIGS. 12 to 14, there are shown various cross-sectional end view of a building section constructed using the fifth embodiment of the composite acoustic damping batten of FIG. 10*c* in position in a floor and ceiling installation with and without the retaining clip 600*a* wherein the substrate 700 is a normal width beam.

Figure 12:
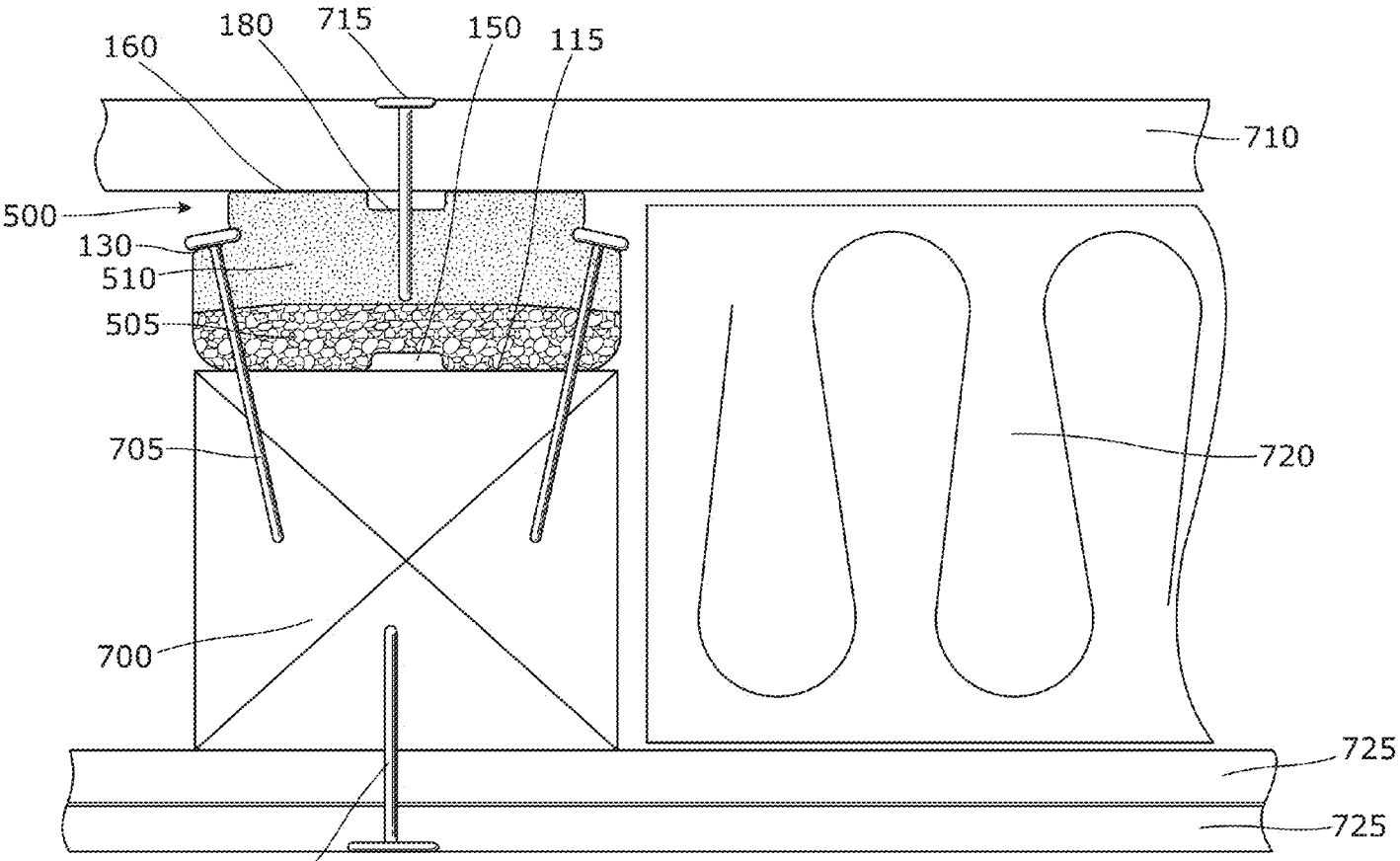
FIG. 12 is a cross-sectional end view of a building section constructed using the fifth embodiment of the composite acoustic damping batten of FIGS. 10*c* and 10*d* in position in a floor and ceiling installation.
Figure 13:
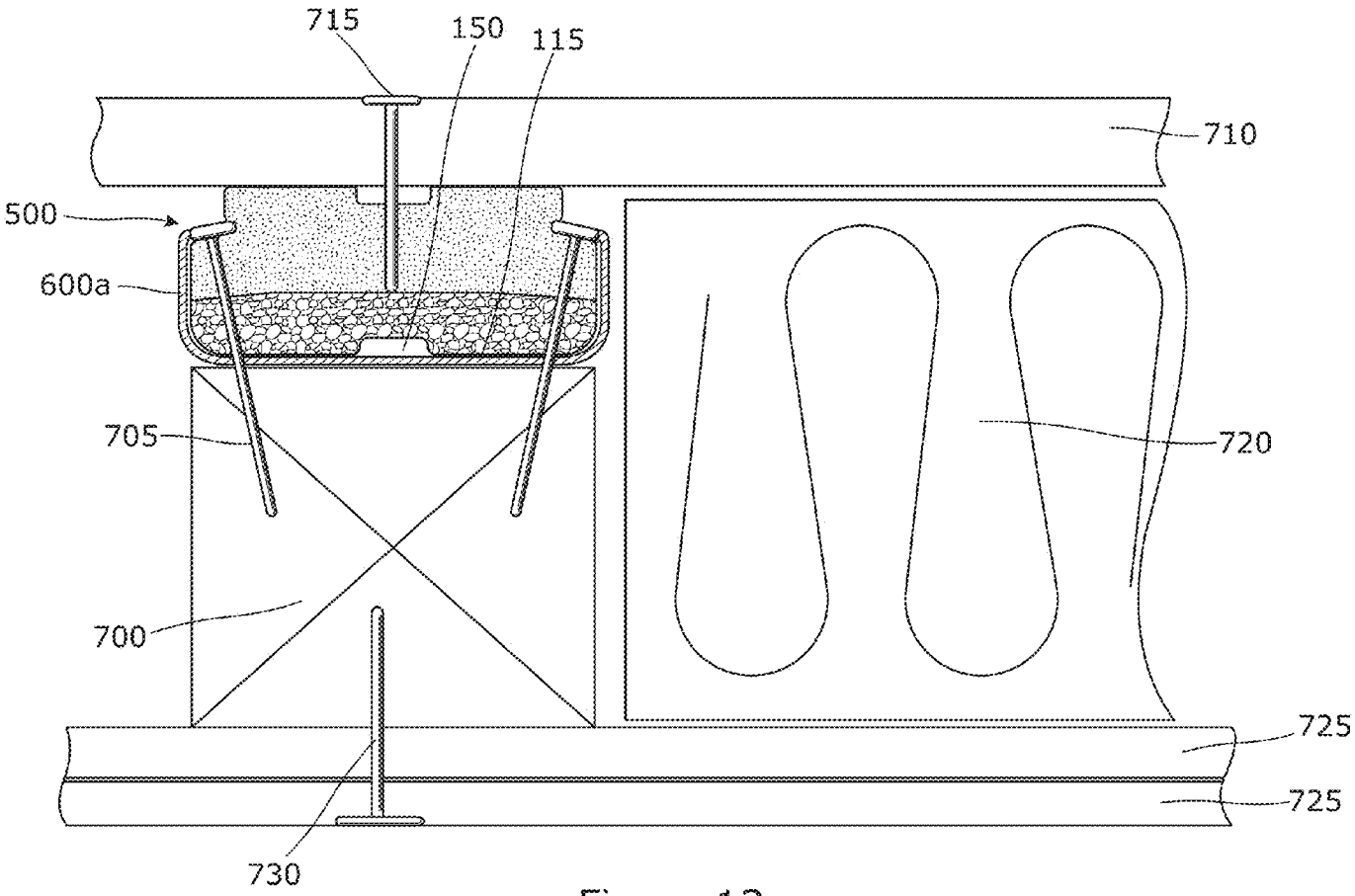
FIG. 13 is a cross-sectional end view of a building section constructed using the fifth embodiment of the composite acoustic damping batten of FIGS. 10*c* and 10*d* together with the retaining clip of FIGS. 6*a* and 6*b* in position in a floor and ceiling installation.
Figure 14:
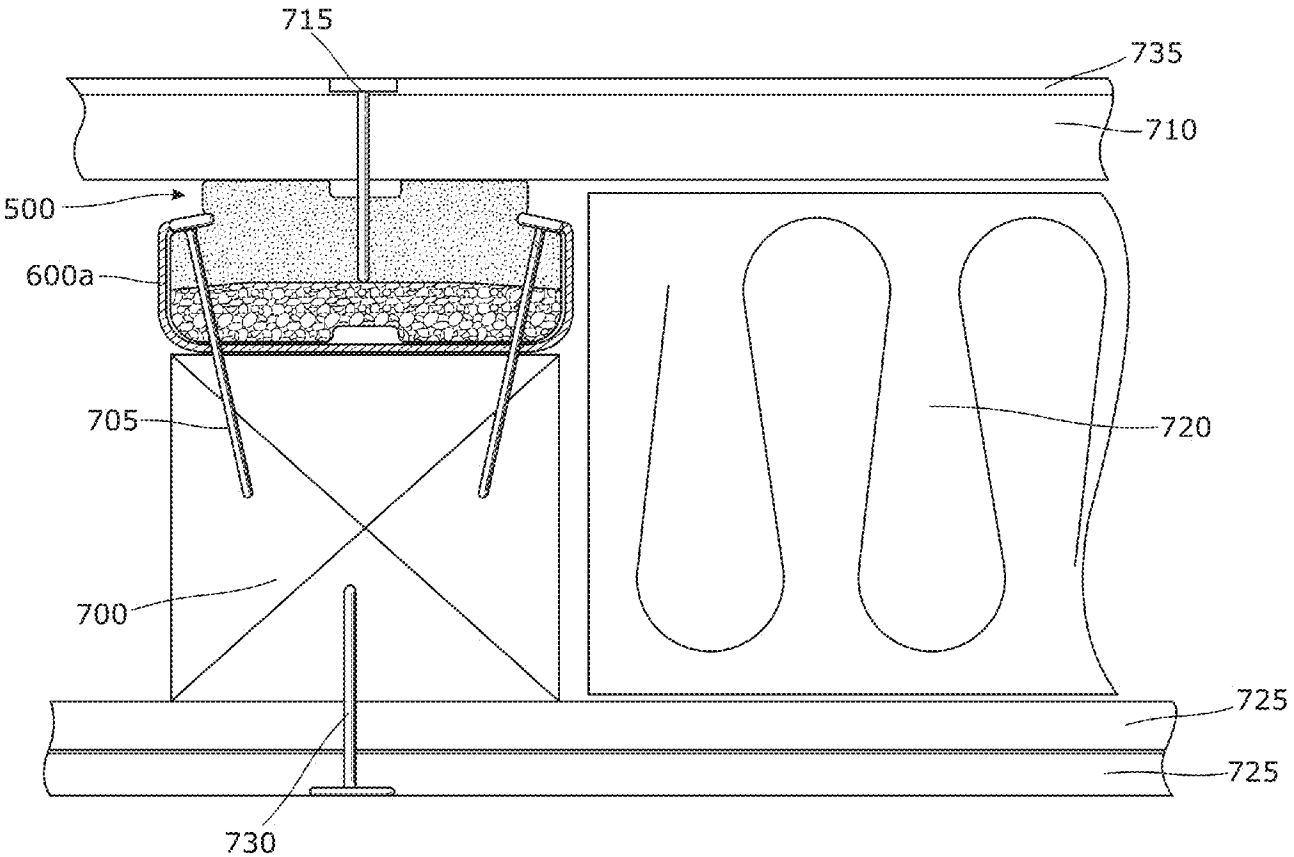
FIG. 14 is a cross-sectional side view of the floor and ceiling installation of FIG. 13 further comprising an acoustic damping layer located on the flooring sheet.

As shown in FIGS. 12 to 14, the composite acoustic damping batten 500 of the invention is functioning as a batten whereby the second resilient portion 505 of composite acoustic damping batten 500 is secured to the substrate or beam 700 using fixing means 705, whilst first material or building sheet 710 is secured to the first resilient portion 510 of composite acoustic damping batten 500 using fixing means 715. The building sheet used was either a fibre cement building sheet or a tongue and groove chipboard flooring sheet as set out in Table 1 below. A double layer of drywall, gypsum board or plasterboard 725 is attached using fixing means 730 to the underside of the beam 700 to form a ceiling for a lower storey. In the drawing a cutaway section of an insulation batt 720 is shown adjacent the composite acoustic damping batten 500 and beam 700. In practise, it is normal to install, a plurality of insulation batts 720 between the beams 700.

FIG. 13 is substantially the same as FIG. 12 however the composite acoustic damping batten 500 of the invention includes retaining clip 600*a*.

In FIG. 14, there is shown an additional acoustic damping layer 735. In one embodiment of the invention, acoustic damping layer comprises at least two media wherein the at least two media are configured such that the acoustic damping layer comprises at least one direct energy transmission pathway and at least one indirect energy transmission pathway through the acoustic damping layer to the substrate 710. It is to be understood that the term direct energy transmission pathway is used to describe a transmission pathway through the acoustic damping layer that enables energy to proceed through the media following a relatively straight course i.e. a pathway that is without interruption. In contrast the term indirect energy transmission pathway is used to describe a transmission pathway through the acoustic damping layer that does not follow such a course, i.e. may include one or more interruptions. In a further embodiment of the invention, the at least two media of the acoustic damping layer are interspersed amongst each other to form the direct and indirect energy transmission pathways. In a further embodiment of the invention, the acoustic damping layer comprises at least two media wherein one of the at least two media comprises a different transmission coefficient (i) to the other of the at least two media.

Figure 15:
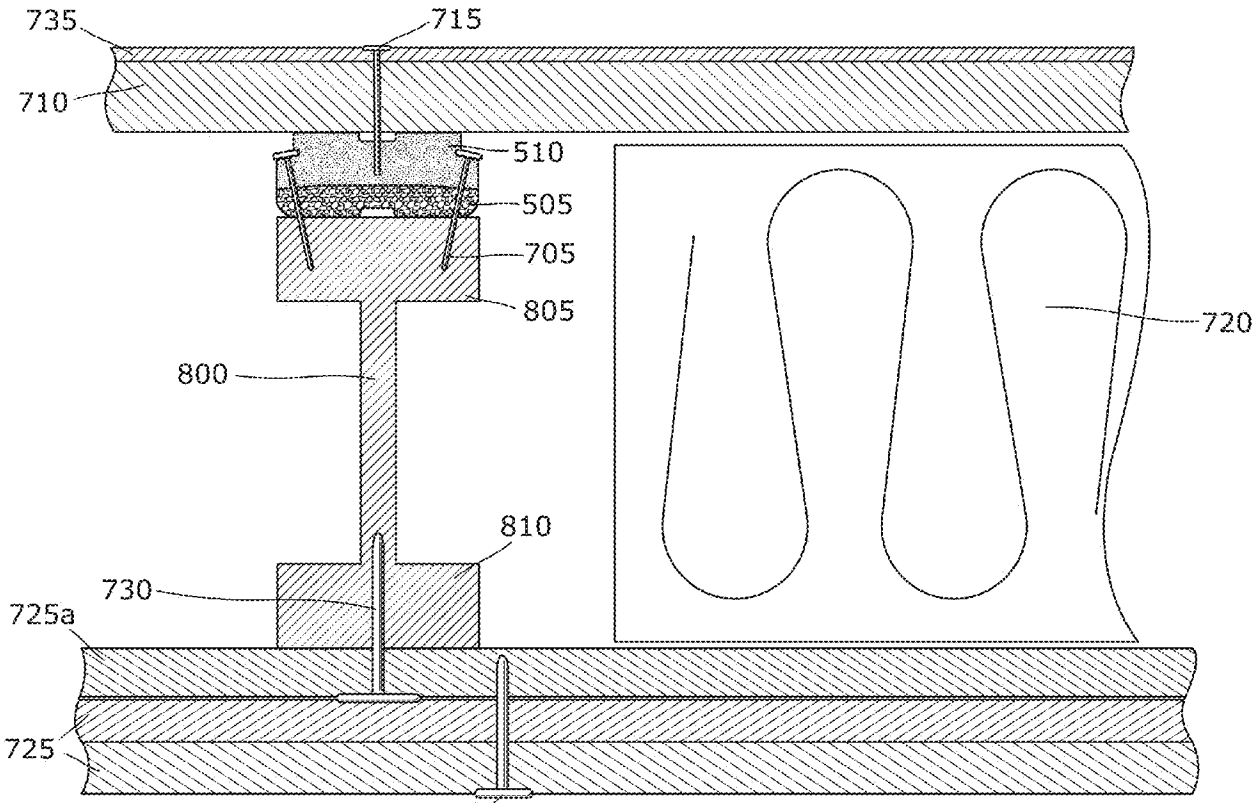
FIG. 15 is a cross-sectional side view of a building section constructed using a composite acoustic damping batten in position in a floor and ceiling installation wherein the beam member is an I-beam.

Turning now to FIG. 15, there is shown a cross-sectional end view of the fifth embodiment of the composite acoustic damping batten of the invention in position in a floor and ceiling installation wherein the beam member is an I-beam 800. The composite acoustic damping batten 500 of the invention is again functioning as a batten whereby the second resilient portion 505 of composite acoustic damping batten 500 is secured to the upper cross member 805 of I beam 800 using fixing means 705. A single layer of drywall, gypsum board or plasterboard 725*a* is attached to the lower cross beam 810 of I beam 800 using fixing means 730. A further double layer of drywall, gypsum board or plasterboard 725 is attached to single layer 725*a* to form a ceiling for a lower storey using fixing means 750.

The composite acoustic damping batten of the invention was tested at various temperatures as a batten in typical floor and ceiling type assemblies with and without additional floor coverings, underfloor heating and or additional acoustic damping features to determine the effectiveness of the composite acoustic damping batten of the invention. The assemblies, test product and measured airbourne and impact transmissions are set out in Table One below.

Sound pressure levels are typically reported in decibel (dB) units. With 0 dB representing the threshold of audibility for a person of normal hearing capacity and 100 dB representing, say, the noise level in a subway railway station or heavy industrial machinery in operation. In a normal daily urban environment, a person may be exposed to sound levels such as average street noise at around 70 dB, an average office environment at around 60 dB, an average conversation at around 50 dB, and a quiet or private office at around 40 dB. The correlation between sound intensity and sound pressure is logarithmic and an increase of 10 dB in sound pressure level represents a 10-fold increase in sound intensity level, so the sound intensity at 100 dB is 10,000,000,000 times greater than that at 0 dB. For a person of normal hearing, a change of 1-2 dB is not detectable. A change of 5 dB, however, is clearly detectable and a change of 10 dB is regarded as either a halving (if reduced by 10 dB) or doubling (if increased by 10 dB) of the noise level. A relatively small change in dB sound levels may, in fact, represent a significant change in the sound intensity in an environment.

Many sounds that people are exposed to in a modern environment span across a range of frequencies from about 50 Hz up to about 10 kHz. Voices are predominantly in the 100-300 Hz range. Heavy vehicles may be in the 50-1000 Hz range and car horns are in the AAA-5000 Hz range. All of the sounds in an environment may reach a person at different sound intensity depending on how far away they are from the source, any material between the person and the source of the sound that may act to absorb or transmit those sounds, and the sound travel pathways available.

The fifth embodiment 500 of the acoustic damping building material of the invention was tested in a combined structural floor, ceiling configuration, such a configuration is typically found between storeys of a multi-storey building construction. The temperature of the area was recorded. In order for the acoustic damping building material of the invention to achieve adequate noise reduction, it is necessary for the airborne noise transmission to be greater than 45 dB whilst the impact noise transmission should be less than 62 dB.

As set out below in Table One, the airborne noise transmission for the various assemblies varies between 59 and 66 dB ($R_w$+($C_{tr}$)) respectively, whilst the impact noise transmission for the various assemblies is between 52 and 58 dB ($L_{n,Tw}$). The results of the test exemplify that the various assemblies using the fifth embodiment of the composite acoustic damping batten of the invention operated to reduce both airborne and impact acoustic, noise or sound transmissions to an acceptable level.

TABLE ONE

| Assembly Detail | | Floor Covering | Structural Floor | Ceiling Configuration | Airbourne/ dB $R_w$ ($C_{tr}$) | Impact/ dB $L_{nT,w}$ | Temp/ ° C. |
|---|---|---|---|---|---|---|---|
| 500 | Fibre Cement Substrate 22 mm | | Joists in the form of I-beams with minimum spacing of 240 mm | Insulation: 100 mm with min value of 10 kg/m$^3$; Resilient Bars: 16 mm × 0.45 mm metal resilient bar; 1$^{st}$ and 2$^{nd}$ ceiling layers: 15 mm Gypsum board 912.5 Kg/m$^2$ | 65 (−9) | 56 | 15 |
| 500 | Fibre Cement Substrate and Single Acoustic Damping Layer 27 mm** | | | | 65 (−7) | 53 | 15 |
| 500 | Single Acoustic Damping Layer and Fibre Cement Substrate 27 mm | | | | 66 (−7) | 52 | 15 |
| 500 | Tongue and Groove Chipboard Flooring 18 mm | Fibre Cement substrate 19 mm overlaying Polypipe overlay lite 22 mm | | | 65 (−6) | 55 | 15 |
| 500 | | Fibre Cement substrate 19 mm | Solid Joists Minimum 200 mm with minimum spacing of 450 mm | | 61 (−11) | 56 | 15 |
| 500 | | Single Acoustic Damping Layer and Fibre Cement substrate 27 mm | | | 59 (−8) | 55 | 15 |
| 500 | | Fibre Cement substrate 19 mm | Floating floor test on Concrete | | N/A | 54 | 15 |
| Assembly Detail | | Floor Covering | Structural Floor | Ceiling Configuration | Airbourne/ dB | Impact/ dB | Temp/ ° C. |
| 500 | | Single Acoustic Damping Layer and Fibre Cement substrate 27 mm | Floating floor test on Concrete | | N/A | 53 | 15 |

TABLE ONE-continued

| | | | | | |
|---|---|---|---|---|---|
| 500 | Fibre Cement substrate 19 mm overlaying Polypipe overlay lite 22 mm | Floating floor test on Concrete | N/A | 58 | 15 |

Airborne Pass Values->45 dB

The $R_w$ ($C_{tr}$) is a measure of the weighted sound reduction index together with the traffic A-weighted spectrum added to take account of low frequency traffic noise in airborne transmissions.

Impact Pass-<62 dB

The $L_{nT,w}$ value is the impact sound pressure level in a stated frequency band, corrected for reverberation time, according to BS EN ISO 140-7:1998.

The acoustic performance of each assembly results which met or exceeded the UK Building Code ADE AAA3 (Resistance to the Passage of Sound) provisions for an $L_{n,Tw}$ maximum value of 64 dB for floors, and stairs in buildings. (The lower the value the better).

The $R_w$ ($C_{tr}$) standards for airborne noise transmission between rooms are also met or exceeded by all examples provided above.

It will of course be understood that the invention is not limited to the specific details described herein, which are given by way of example only, and that various modifications and alterations are possible within the scope of the invention as defined in the appended claims.

The invention claimed is:

1. A composite acoustic damping batten suitable for interposition between first and second building elements, the composite acoustic damping batten comprising:

at least two differently shaped resilient portions, each resilient portion comprising a first face and a second face, the at least two resilient portions being conjoined such that the first face of a first resilient portion and the second face of a second resilient portion are spaced apart from each other to form opposing external surfaces of the composite acoustic damping batten and such that the second face of the first resilient portion abuts the first face of the second resilient portion along substantially the entire length of the composite acoustic damping batten;

wherein the first face of the first resilient portion is configured for contacting engagement with a first building material such that the first building material and the first resilient portion of the acoustic building element are securable together;

wherein the second face of the second resilient portion is configured for contacting engagement with a second building material such that the second building material and the second resilient portion of the acoustic building element are securable together; and wherein the first and second resilient portions each comprise a complementary mating surface profile, each complementary mating surface profile comprising a protrusion or a recess having a uniform cross section extending along substantially the entire length of the composite acoustic damping batten.

2. A composite acoustic damping batten as claimed in claim 1, wherein the at least two resilient portions comprise materials which have different Shore hardness measurements as measured on the Shore A durometer scale relative to each other.

3. A composite acoustic damping batten as claimed in claim 1, wherein one of the at least two resilient portions comprises a material which is harder than the other of the at least two resilient portions when measured on the Shore A durometer scale.

4. A composite acoustic damping batten as claimed in claim 1, wherein one or more of the at least two resilient portions comprises a material which has a Shore hardness of greater than or equal to 55±3 as measured on the Shore A durometer scale.

5. A composite acoustic damping batten as claimed in claim 1, wherein one or more of the at least two resilient portions comprises a material which has a Shore hardness of between 30±3 and 55±3 as measured on the Shore A durometer scale.

6. A composite acoustic damping batten as claimed in claim 1, wherein one of the at least two resilient portions comprises a material which has a Shore Hardness of greater than or equal to 55±3 as measured on the Shore A durometer scale whilst the other of the at least two resilient portions has a Shore Hardness of between 30±3 and 55±3 as measured on the Shore A durometer scale.

7. A composite acoustic damping batten as claimed in claim 1, wherein one of the at least two resilient portions comprises a material which has a different sound transmission coefficient (τ) than the other of the at least two resilient portions.

8. A composite acoustic damping batten as claimed in claim 1, wherein one or more of the at least two resilient portions are formed from a range of resilient materials, preferable polymeric materials.

9. A composite acoustic damping batten as claimed in claim 1, wherein one or more of the at least two resilient portions comprise at least one elastomeric polymeric material selected from the group of materials comprising natural rubber, synthetic rubbers, gutta percha, styrene-butadiene rubbers, nitrile rubbers, polybutadiene rubbers, chloroprene rubbers, isoprene rubbers, halogenated butyl rubbers, ethylene propylene rubber, ethylene propylene diene rubbers, epichlorhydrin rubbers, polyacrylic rubbers, fluoroelastomers, perfluoroelastomers, silicone rubbers and polyether block amides (PEBA's).

10. A composite acoustic damping batten as claimed in claim 1, wherein one or more of the at least two resilient portions comprises at least one expandable polymeric material selected from the group comprising polyolefins, polyurethanes, polyvinyl chlorides, polyimides, polystyrenes, and polysiloxanes.

11. A composite acoustic damping batten as claimed in claim 1, wherein one or more of the at least two resilient portions comprises a foamed polymeric material.

12. A composite acoustic damping batten as claimed in claim 1, wherein the composite acoustic damping batten comprises further resilient portions intermediate the first and second resilient portions.

13. A composite acoustic damping batten as claimed in claim 1, wherein the resilient portions of the composite acoustic damping batten are separately formed.

14. A composite acoustic damping batten as claimed in claim 1, wherein the resilient portions of the composite acoustic damping batten are integrally formed.

15. A composite acoustic damping batten as claimed in claim 1, wherein the first and second resilient portions are configured such that the first and second resilient portions are resiliently biased towards each other.

16. A composite acoustic damping batten as claimed in claim 1, wherein each complementary mating surface profile comprises at least one retaining formation.

17. A composite acoustic damping batten as claimed in claim 1, wherein each complementary mating surface profile comprises at least one protrusion on the second surface of the first resilient portion and a corresponding at least one recess on the first surface of the second resilient portion or at least one protrusion on the first surface of the second resilient portion and a corresponding at least one recess on the second surface of the first resilient portion.

18. A composite acoustic damping batten as claimed in claim 1, wherein the at least two resilient portions comprise at least one pair of side edges.

19. A composite acoustic damping batten as claimed in claim 18, wherein the at least one pair of side edges further comprises one or more sections selected from the group comprising angled, profiled or stepped sections.

20. A composite acoustic damping batten as claimed in claim 18, wherein the side edges of the at least two resilient portions are configured to include retaining means to restrain and/or lock the at least two resilient portions together.

21. A composite acoustic damping batten as claimed in claim 18, wherein the at least one pair of side edges comprise at least one fixing indicium.

22. A composite acoustic damping batten as claimed in claim 21, wherein the fixing indicium comprises any one of a surface marking, an indentation, a notch or a groove.

23. A composite acoustic damping batten as claimed in claim 1, wherein the composite acoustic damping batten further comprises a retaining clip, for receiving and retaining at least one of the resilient portions.

24. A composite acoustic damping batten as claimed in claim 23, wherein the retaining clip comprises a central web, a pair of side arms each extending from a respective edge of the central web, a retaining formation adjacent the end of each of the pair of side arms, and at least one aperture in each side arm for receiving a fixing.

* * * * *